US012285642B2

(12) United States Patent
Valente et al.

(10) Patent No.: US 12,285,642 B2
(45) Date of Patent: Apr. 29, 2025

(54) EXERCISE MACHINE WITH RETRACTABLE ARM

(71) Applicant: Tonal Systems, Inc., San Francisco, CA (US)

(72) Inventors: Michael Valente, San Francisco, CA (US); Robin Barata, San Francisco, CA (US); David Mallard, Mill Valley, CA (US); Mickey Chad Makay, Santa Clara, CA (US); Daniel Jordan Kayser, Mill Valley, CA (US); Alex Kensil, Oakland, CA (US); Graham Philip Arrick, San Francisco, CA (US); Andrew Mello, San Francisco, CA (US); Travis Weisberger, Sunnyvale, CA (US)

(73) Assignee: Tonal Systems, Inc., San Francisco, CA (US)

( * ) Notice: Subject to any disclaimer, the term of this patent is extended or adjusted under 35 U.S.C. 154(b) by 712 days.

(21) Appl. No.: 17/503,937

(22) Filed: Oct. 18, 2021

(65) Prior Publication Data

US 2022/0118301 A1 Apr. 21, 2022

Related U.S. Application Data

(60) Provisional application No. 63/093,653, filed on Oct. 19, 2020.

(51) Int. Cl.
*A63B 21/005* (2006.01)
*A63B 21/00* (2006.01)

(52) U.S. Cl.
CPC ..... *A63B 21/0058* (2013.01); *A63B 21/4035* (2015.10); *A63B 21/4047* (2015.10); *A63B 2225/09* (2013.01)

(58) Field of Classification Search
CPC ..... A63B 21/0058; A63B 21/4035; A63B 21/4047; A63B 21/159; A63B 24/0087; A63B 21/00072; A63B 71/0622; A63B 2071/0625; A63B 2210/58; A63B 2220/803; A63B 2220/805; A63B 2225/50; A63B 21/169; A63B 21/15; A63B 21/151; A63B 21/152; A63B 21/153;
(Continued)

(56) References Cited

U.S. PATENT DOCUMENTS 2,267,376 A * 12/1941 Malm ..... A63B 21/154 482/130
4,817,943 A * 4/1989 Pipasik ..... A63B 21/4035 482/137
(Continued)

FOREIGN PATENT DOCUMENTS

CN 111760246 10/2020
WO 2021011563 1/2021

*Primary Examiner* — Sundhara M Ganesan
(74) *Attorney, Agent, or Firm* — Van Pelt, Yi & James LLP

(57) ABSTRACT

A weight training machine includes a central console including a motor. It further includes an arm having a length attached on either side of the console by a joint that allows rotation of the arm in a substantially vertical plane. It further includes a cable routed from the motor through the arm to a distal end of the arm. The cable terminates at an attachment point. The arm includes an outer section and an inner section arranged to telescope in a manner that changes the length of the arm.

14 Claims, 39 Drawing Sheets

(58) Field of Classification Search
CPC . A63B 21/40; A63B 21/4033; A63B 2210/00; A63B 2210/50; A63B 2225/09
See application file for complete search history.

(56) References Cited

U.S. PATENT DOCUMENTS

| | | | | |
|---|---|---|---|---|
| 7,722,509 | B2 | 5/2010 | Eder | |
| 9,539,458 | B1 * | 1/2017 | Ross | A63B 21/4043 |
| 9,688,340 | B1 * | 6/2017 | Kroymann | A63C 17/28 |
| 10,393,163 | B2 * | 8/2019 | Ucgun | A63B 21/4035 |
| 10,441,840 | B2 | 10/2019 | Dalebout | |
| 10,456,614 | B1 * | 10/2019 | Dube | A63B 24/0062 |
| 2003/0017918 | A1 * | 1/2003 | Webb | A63B 21/156 482/99 |
| 2007/0282228 | A1 * | 12/2007 | Einav | A63B 21/00181 600/300 |
| 2008/0153682 | A1 * | 6/2008 | Chen | A63B 21/4035 482/136 |
| 2010/0151995 | A1 | 6/2010 | Forman | |
| 2014/0213414 | A1 * | 7/2014 | Balandis | A63B 21/169 482/111 |
| 2015/0335951 | A1 * | 11/2015 | Eder | G16H 20/30 482/8 |
| 2016/0107021 | A1 * | 4/2016 | Bakrac | A63B 21/00065 482/139 |
| 2016/0199245 | A1 * | 7/2016 | Mikulski | A63B 23/0355 601/33 |
| 2017/0361165 | A1 * | 12/2017 | Miller | A63B 21/4047 |
| 2018/0345074 | A1 * | 12/2018 | Shiao | A63B 23/12 |
| 2019/0099636 | A1 * | 4/2019 | Schmidt | A63B 23/0405 |
| 2020/0047027 | A1 * | 2/2020 | Ward | G06F 3/0346 |
| 2020/0047030 | A1 | 2/2020 | Ward | |
| 2020/0047053 | A1 | 2/2020 | Ward | |
| 2020/0047054 | A1 | 2/2020 | Ward | |
| 2020/0047055 | A1 | 2/2020 | Ward | |
| 2020/0054914 | A1 | 2/2020 | Lafrance | |
| 2020/0054929 | A1 | 2/2020 | Ward | |
| 2020/0139181 | A1 * | 5/2020 | Thomas | A63B 1/00 |
| 2020/0254294 | A1 * | 8/2020 | Jaquish | G16H 50/30 |
| 2020/0254295 | A1 | 8/2020 | Watterson | |
| 2021/0162256 | A1 * | 6/2021 | Anani | A63B 24/0087 |
| 2021/0275868 | A1 * | 9/2021 | Rothacker | A63B 21/078 |
| 2022/0001914 | A1 * | 1/2022 | Kakita | B62D 1/185 |
| 2022/0258006 | A1 * | 8/2022 | Norris | A63B 22/0242 |
| 2024/0226637 | A1 * | 7/2024 | Sekanina | A63B 21/0058 |

* cited by examiner

EXERCISE MACHINE WITH RETRACTABLE ARM

CROSS REFERENCE TO OTHER APPLICATIONS

This application claims priority to U.S. Provisional Patent Application No. 63/093,653 entitled EXERCISE MACHINE WITH RETRACTABLE ARM filed Oct. 19, 2020 which is incorporated herein by reference for all purposes.

BACKGROUND OF THE INVENTION

Strength training, also referred to as resistance training or weight lifting, is an important part of any exercise routine. It promotes the building of muscle, the burning of fat, and improvement of a number of metabolic factors including insulin sensitivity and lipid levels. It would be beneficial to have a strength training machine that is capable of being configured in a variety of ways to perform various strength training exercises.

BRIEF DESCRIPTION OF THE DRAWINGS

Various embodiments of the invention are disclosed in the following detailed description and the accompanying drawings.

DETAILED DESCRIPTION

Figure 1A:
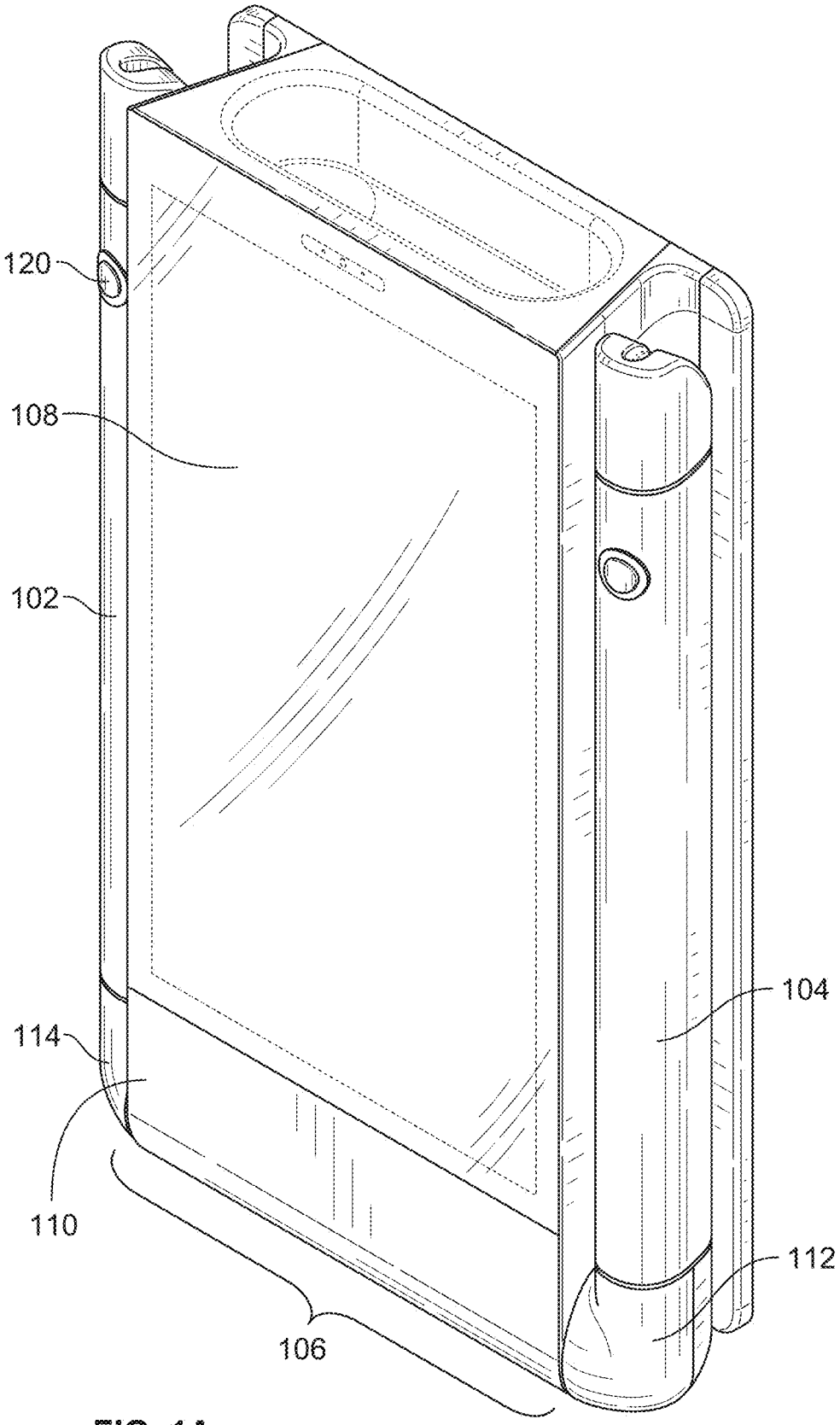
FIGS. 1A-1F illustrate embodiments of front perspective views of an exercise machine with telescoping arms.

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention. Unless stated otherwise, a component such as a processor or a memory described as being configured to perform a task may be implemented as a general component that is temporarily configured to perform the task at a given time or a specific component that is manufactured to perform the task. As used herein, the term 'processor' refers to one or more devices, circuits, and/or processing cores configured to process data, such as computer program instructions.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

Described herein are embodiments of an exercise machine, such as a weight training machine, with telescoping arms. In some embodiments, the exercise machine includes a central console. In some embodiments, the central console includes a load element such as one or more motors. In some embodiments, an arm of the exercise machine has a length attached on either side of the console by a joint that allows rotation of the arm in a substantially vertical plane. In some embodiments, the arm includes an outer section and an inner section arranged to telescope in a manner that changes the length of the arm. In some embodiments, the exercise machine includes a cable that is routed from the motor through the arm to a distal end of the arm. In some embodiments, the cable terminates in an attachment, where, for example, an actuator such as a handle may be attached to allow a user to perform exercise.

FIGS. 1A-1F illustrate embodiments of front perspective views of an exercise machine with telescoping arms. In this example, the exercise machine has two telescoping arms.

FIG. 1A illustrates an embodiment of a front perspective view of an exercise machine with the arms in a stowed position, where the arms are upright and retracted. Examples of telescoping arms are arms 102 and 104.

Figure 1B:
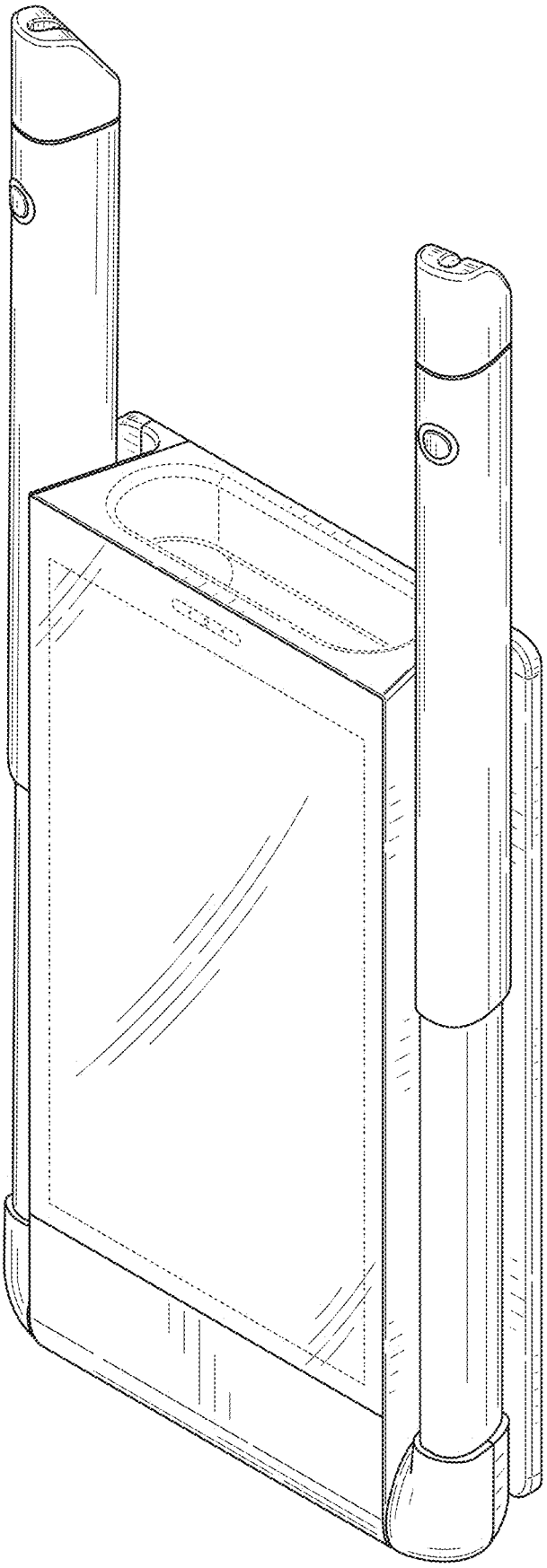

FIG. 1B illustrates an embodiment of a front perspective view of an exercise machine with the arms in a stowed position, where the arms are upright and extended.

Figure 1C:
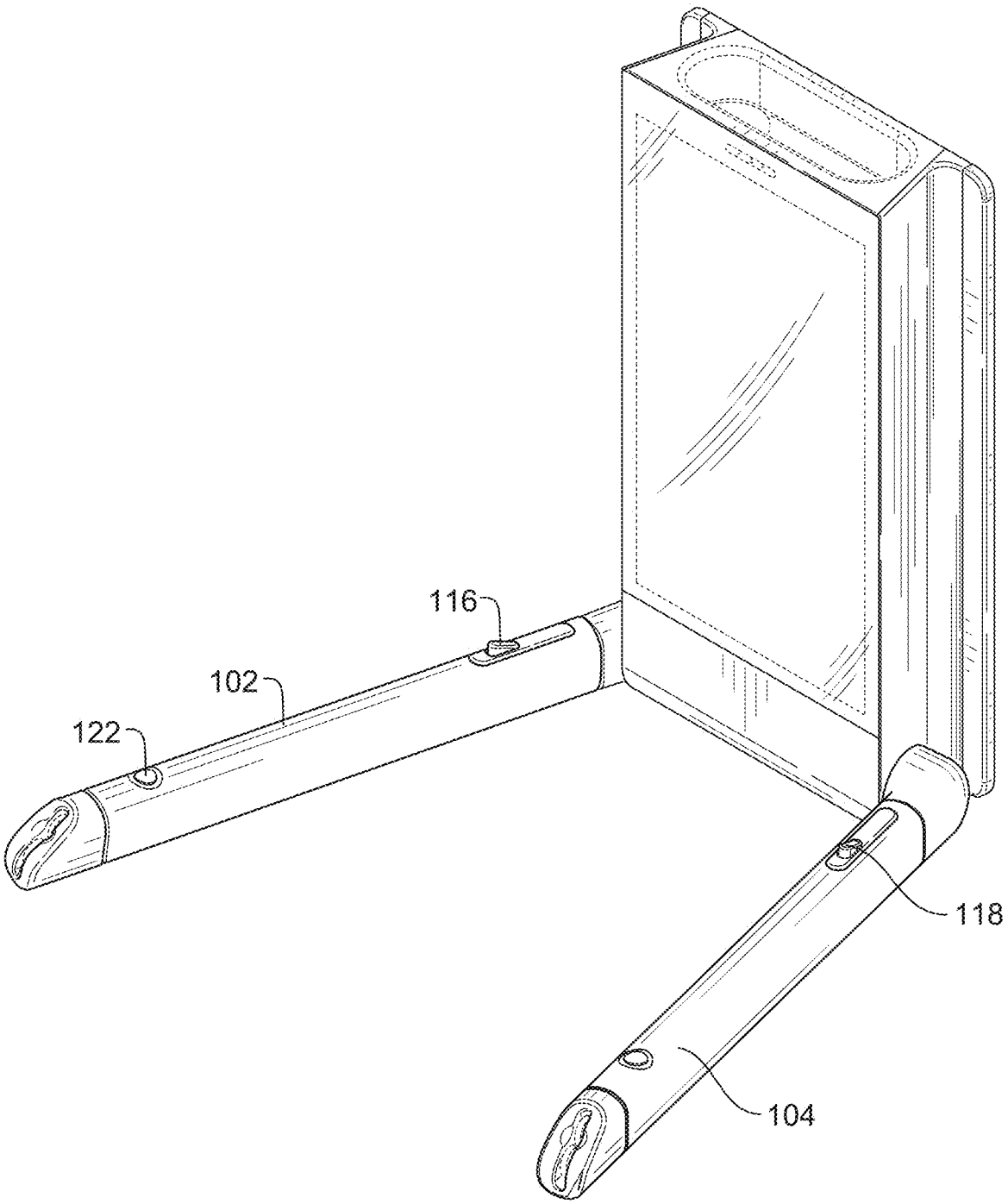

FIG. 1C illustrates an embodiment of a front perspective view of an exercise machine with the arms in mid-vertical pivot, where the arms are retracted. In this example, controls 116 and 118 on arms 102 and 104, respectively, are used to unlock adjustment of the telescoping of the arms.

Figure 1D:
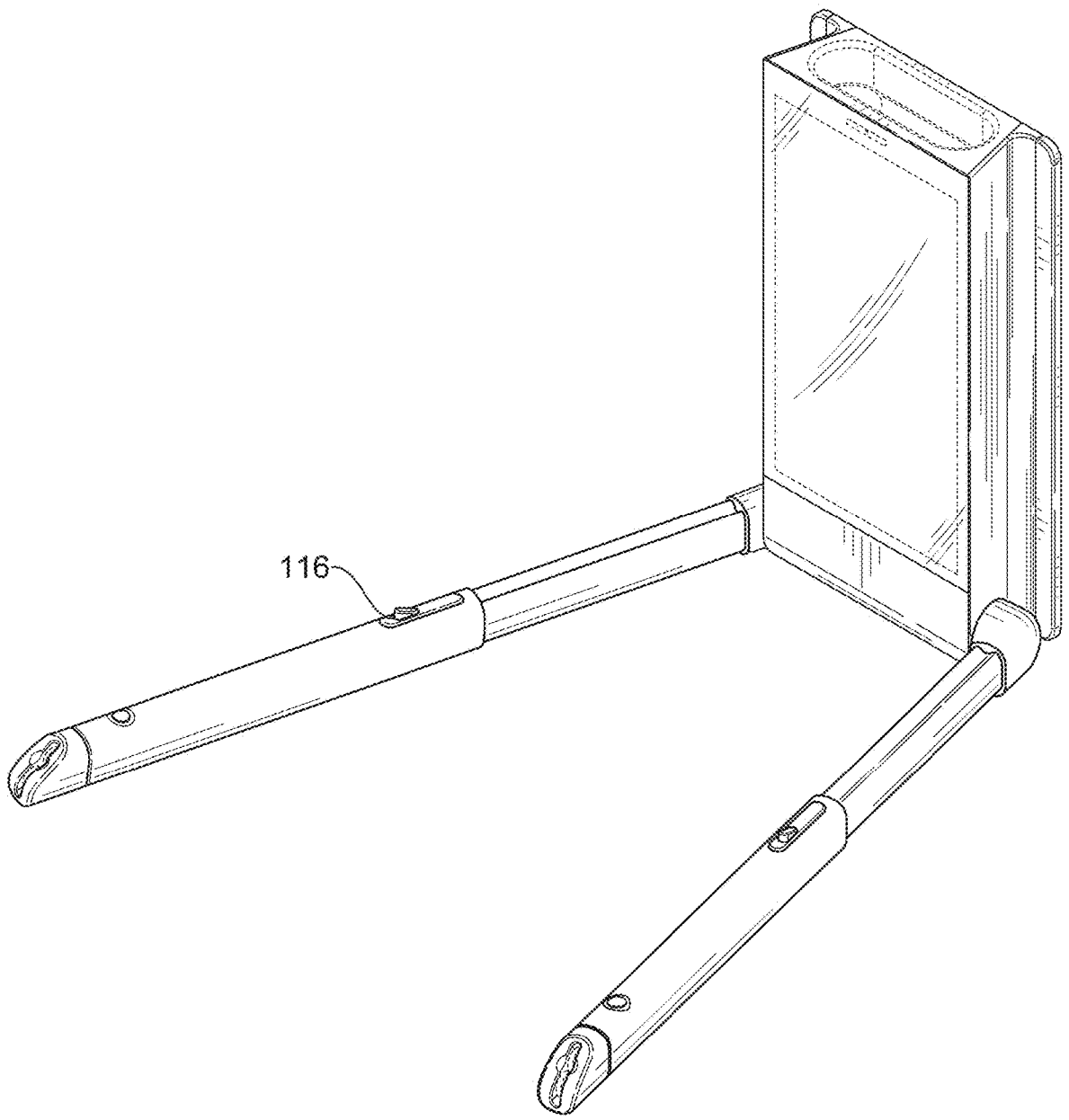

FIG. 1D illustrates an embodiment of a front perspective view of an exercise machine with the arms in mid-vertical pivot, where the arms are extended.

Figure 1E:
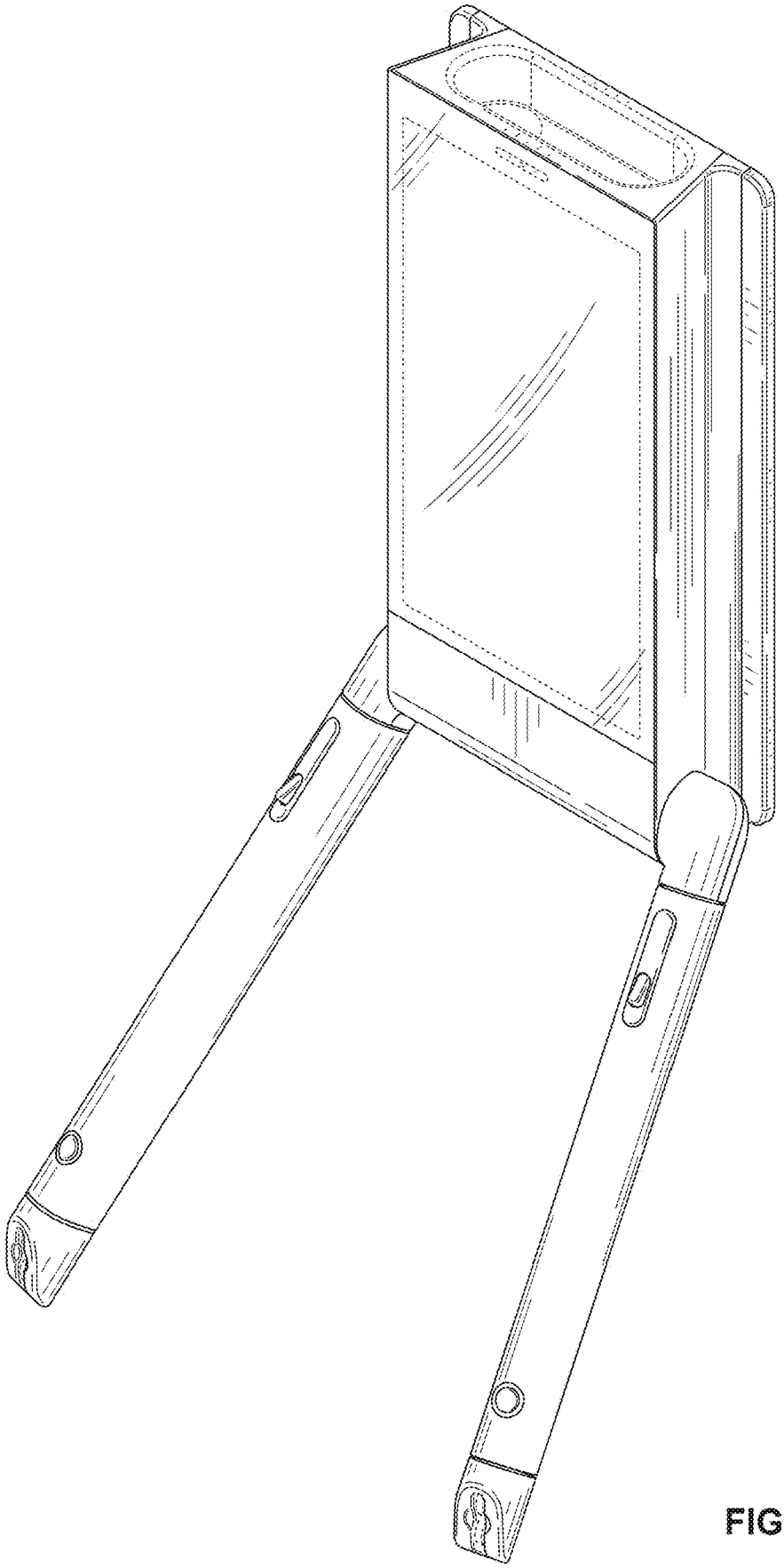

FIG. 1E illustrates an embodiment of a front perspective view of an exercise machine with the arms rotated downward, where the arms are retracted.

Figure 1F:
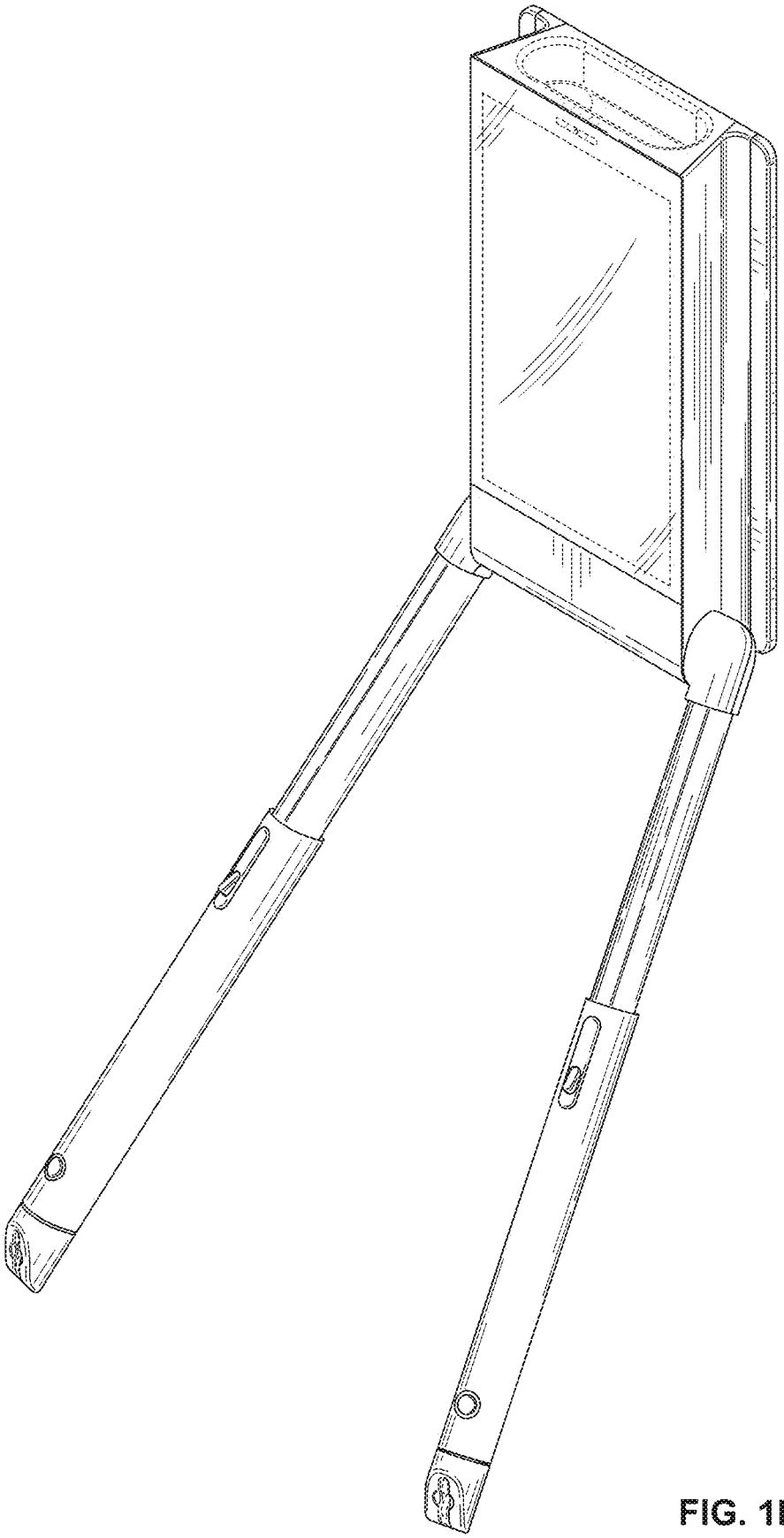

FIG. 1F illustrates an embodiment of a front perspective view of an exercise machine with the arms rotated downward, where the arms are extended.

While three angles of vertical pivot are shown in the examples of FIGS. 1A-1F for illustrative purposes, the arms may be independently pivoted to any angle as appropriate. While two positions of telescoping (either fully retracted or extended) are shown in the examples of FIGS. 1A-1F for illustrative purposes, the arms may be independently telescoped to any number of positions/lengths as appropriate.

Further details regarding the telescoping and pivoting arms are described below.

In this example, the exercise machine of FIGS. 1A-1F is an embodiment of a digital strength trainer that uses a motor as a load element to provide electronic resistance. The telescoping arms described herein may be adapted to accommodate any other type of exercise machine with any other type of load element (e.g., weights, springs, a combination of weights and springs, flywheel with brake, etc.), as appropriate.

In this example, cables travel within the arms, where one end of a cable in a given arm is coupled or otherwise connected to the load element(s) (which may be in the body of the exercise machine). In some embodiments, at the distal end of an arm (away from the body/central console 106 of the trainer, as shown in FIG. 1A) is a handle attached to one end of a cable. A handle is but one example of an actuator that may be used by a user to perform exercise.

In some embodiments, the exercise machine is mounted to a wall. In other embodiments, the exercise machine is floor mounted. The exercise machine may also be a combination of wall/floor mounted. For example, the exercise machine may be mounted to the wall as well as bolted to the floor. The exercise machine may also stand on the floor while being wall mounted. In other embodiments, the exercise machine is freestanding. For example, the exercise machine is attached to a moveable stand, where the stand need not be hard mounted.

In some embodiments, the exercise machine includes an antenna, a camera (as well as other optical sensors, such as depth sensors, infrared sensors, etc.), a display, a touch screen, a touch screen controller, an audio input device (e.g., a microphone), an audio output device (e.g., a speaker), a motor controller, one or more electric motors, and actuators such as handles. An example of a screen is shown at 108 of FIG. 1A. An example of a speaker is shown at 110 of FIG. 1A. The motor controller, the handles, and the electric motor are exemplary controllers, exercising components/actuators, and resistive devices/load elements, respectively. In some embodiments, the exercise machine includes multiple motors (e.g., one per arm, where an embodiment of a two arm exercise machine such as that shown in FIGS. 1A-1F has two motors, an embodiment of a four arm exercise machine has four motors, etc.).

In some embodiments, the exercise machine includes a central console for controlling the exercise machine. In the example exercise machine shown in FIGS. 1A-1F, the exercise machine includes a display. In some embodiments, the display is a touch screen. In this example, the display allows instructional information (e.g., virtual training content) to be presented to the user and with which a user interacts. In some embodiments, to reduce the interference with an exercise routine that occurs whenever a user interacts with the exercise appliance/machine features or controls (e.g., because the user releases one of the handles in order to use the now free hand to modify settings selected from options indicated at the display, or moves physical controls located at the control panel, often proximate to the display), controls are incorporated in the handle. By suitable location of the user controls and application of control context information, the user is able to alter the exercise machine settings without undue pause.

While the example exercise machine shown here includes an embedded display, in other embodiments, the exercise machine does not have a display. In some embodiments, the exercise machine is connected to a television or touchscreen monitor via a connection such as HDMI, USB, displayport, etc. In some embodiments, images, audiovisual content, etc. are transmitted wirelessly to the external display device or other receiver devices (e.g., set top boxes, game consoles, etc.). Additionally, in some embodiments, data is sent to an application on a mobile device such as a tablet or smartphone, where the application then interprets and renders a user interface for interacting with the exercise machine, viewing exercise data measured by the exercise machine, etc.

In the examples of FIGS. 1A-1F, the arms of the exercise machine have two degrees of freedom (DOFs) of movement: a rotation of the arm relative to the ground (also referred to herein as arm vertical pivoting in the "sagittal" plane); and telescoping of the arm (e.g., retraction/collapsing of the arm and extension of the arm). Details and embodiments regarding vertical pivoting and telescoping arms are described in further detail below. As shown in the example of FIGS. 1A-1F, the arms pivot about shoulder joints 112 and 114.

In the examples of FIGS. 1A-1F, the arms of the exercise machine are angled outwards from the body (also referred to herein as the central console) of the machine. For example, the sides of the body/frame of the machine are not perpendicular, but rather are slanted outwards.

As shown in the example of FIG. 1A, when the arms are in an upper position, the exercise machine is in a more compact form. This is compared to the example perspective view shown in FIG. 1C, where when the arms are rotated such that they are parallel to the ground, the arms extend out wider due to the angle. As shown in the example of FIGS. 1A, 1C, and 1E, the angling of the arms allows the arms to have a distance between them that is, for example, close to a person's hand-to-hand width.

In some embodiments, angled arms are used in lieu of having an additional degree of freedom, where the arms also pivot horizontally. By having the arms on a pivot angle, when the arms pivot, they start (e.g., when pointed upward) in their most compact (least wide) configuration, and widen as they move downwards. This allows the distance between the arms to vary based on the pivot angle, as shown in FIGS. 1C and 1E. The use of angled arms provides various benefits, for example, by simplifying the design of the arms and reducing complexity and cost (e.g., by removing the need to have mechanisms to allow the arms to pivot horizontally), but still retaining a similar amount of functionality (as would be provided by implementing horizontal pivoting of the arms). In some embodiments, the pivot angle may be determined based on a desired width when the arms are in various positions (e.g., pivoted down in a lower position, at center, and/or at an upper position). The dimensions shown in the examples of FIGS. 1A-1F are but examples of widths for illustrative purposes, and other widths/dimensions between the arms may be accommodated in various embodiments.

As shown in the examples of FIGS. 1A-1F, angling of the arms is implemented by angling the sides of the exercise machine body/frame so that when the arms are extended, they are wider than the body is in total, and when the arms are folded up, they are at their smallest width. However, when extended, the arms are positioned out wider to fit a person performing exercises such as a bench press. As described above, this angling may be performed instead of implementing horizontal rotation of the arms.

Further, with the use of angled arms, the width between the arms (e.g., between the distal ends of the arms to which the actuators such as handles are located) may be varied/changed by retracting/extending the arms and/or pivoting them vertically, as shown in the examples of FIGS. 1C and 1D, as well as FIGS. 1E and 1F. This allows for variability in the width via the two degrees of freedom (vertical pivot and telescoping), based on the angle. Different lengths of telescoping would also provide different widths (independently of the vertical pivot).

In the example of FIGS. A-1F, the angled arms are implemented by slanting the sides of the frame. The angling of the arms may be implemented in other ways. For example, in other embodiments, the frame is flat/square, and the angled arms are implemented by using a bend in an arm tube near the proximal end of the arm connected to the body/frame/central axis of the exercise machine. In an alternative embodiment, the frame is not bent/angled, but the axis of rotation is bent.

The telescoping, along with the vertical pivot and angled out arms, allows for the arms to provide a large range of motion, while also allowing the trainer to be stowed to a compact form when not in use. As shown in the example of FIG. 1A, when the telescoping arms are stowed and fully retracted, what is presented to the user is primarily the body of the trainer, such as the screen and speakers. With the combination of the vertical pivot and the telescoping arms, as shown in the example of FIG. 1F, the arms may reach to the floor by pivoting the arms downward and extending the arms outward. By pivoting the arms upward and extending arms outward, then the arms may be configured to reach higher, for example, for overhead workouts. Thus, the telescoping, along with the vertical pivot rotation, and angling outwards of the arms, provides a range of motion that covers a vast majority of workouts.

Telescoping

As shown in the examples of FIGS. 1B, 1D, and 1F, the telescoping arm includes two components, an outer tube and an inner tube, where the telescoping is facilitated by sliding the outer tube relative to the inner tube (where the outer tube moves, and the inner tube is fixed). In this example, the outer tube can move away from the body (distally), or move toward the body/central console (e.g., proximally). When fully extended, the outer tube is a distal section that is away from the body. The inner tube, which is fixed, is located proximally to the body.

Figure 2:
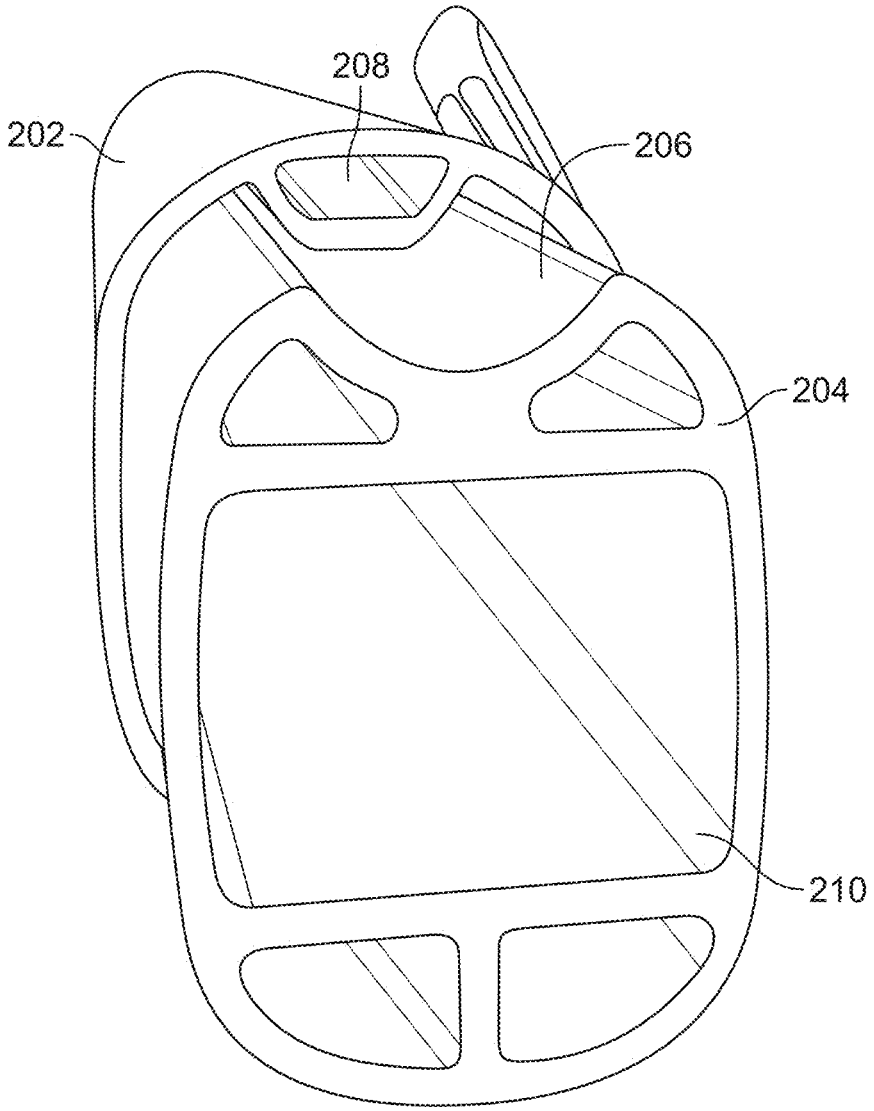
FIG. 2 illustrates an embodiment of a cross-section of a telescoping arm.

FIG. 2 illustrates an embodiment of a cross-section of a telescoping arm. In this example, a cross section of the arm as viewed from the proximal end of the arm (nearest the trainer) towards the distal end (away from the trainer) is shown. Shown in this example are the outer tube/arm 202 and the inner tube/arm 204. The inner arm is sitting inside of the outer arm in this example. As described above, and as shown in the example of FIGS. 1B, 1D, and 1F, the outer tube is the portion of the arm that slides relative to the inner tube for extending/retracting the telescoping.

As shown in this example, the tubes are of a squircle shape. The squircle shape prevents the tubes from spinning inside of each other (e.g., if they were circular). Another use of the squircle shape is for aesthetic purposes. For example, when the arms are stowed, as shown in the example of FIG. 1A, the arms are displayed. The flat side of the arms integrates with the body of the trainer when in the stowed position.

As shown in the example of FIG. 2, the inner and outer tubes include various tracks and channels. Track 206 guides the sliding of the outer tube over the inner tube.

In this example, the outer arm 202 includes a channel 208 that allows the locking mechanisms described herein to be synchronized to lock the outer tube to the inner tube. In some embodiments, componentry may be located in the channel.

As shown in this example, the inner tube/arm 204 includes various channels. In some embodiments, the mechanical cable (that the user pulls on when performing exercise) passes through the center channel 210. Four other channels (on the outer edges of the inner arm) are shown in this example of the inner tube. As one example, one channel may be used to send signals such as light for unlocking the arm vertical pivot rotation mechanism (e.g., IR reflector-based rotation unlock, as described in further detail below). Another channel may be used to include a component such as a gas spring to facilitate extending and retracting of the arm. As another example, a rod or lock may be placed in a channel to limit the telescoping (so that the user cannot pull the outer arm completely off of the inner arm).

The following are examples and embodiments of controls/mechanisms for unlocking of the telescoping feature of the arms described herein.

Lever-Style Unlock/Lock Mechanism

As one example, a button is provided to unlock the outer tube from the inner tube and allow the user to adjust the telescoping of the arm.

Figure 3A:
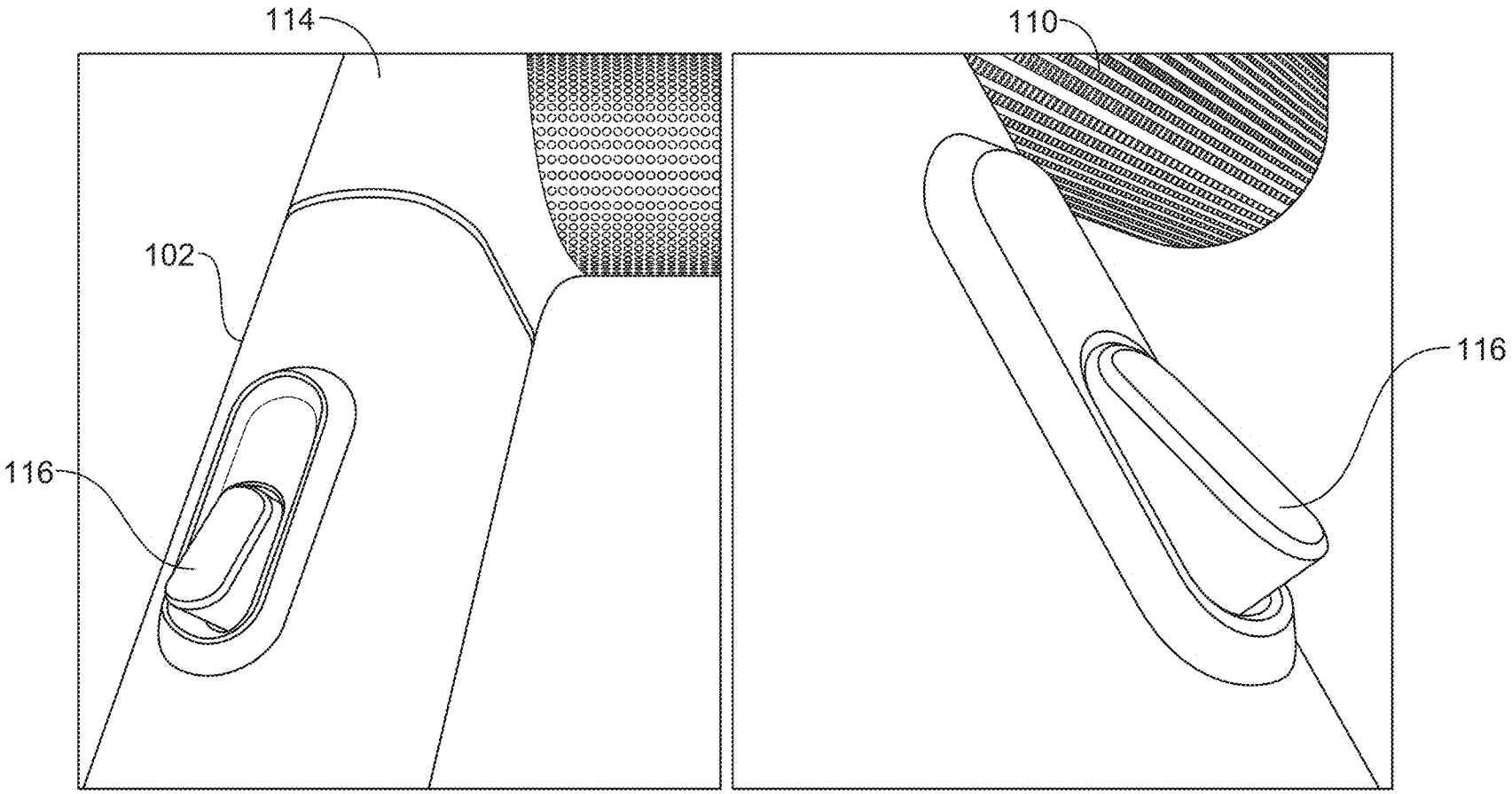
FIG. 3A illustrates an embodiment of a portion of an exercise machine.

FIG. 3A illustrates an embodiment of a portion of an exercise machine. Shown in the example of FIG. 3A are a portion of the bottom of the body 106 of the trainer with speaker 110, shoulder joint 114, and a portion of the arm 102 with the outer arm fully retracted. In one embodiment, the telescoping control button (116) is placed on the end of the outer tube that is closer to the body 106 of the trainer. In this way, when the outer tube is fully extended (as shown in the example of FIG. 1D), the telescoping release button is at the middle of the arm when the arm is fully extended (and can be reached by the user). This allows for the button to be easily reached, even when the arms are pivoted upwards. In this example, a lever style angled button is shown.

Figure 3B:
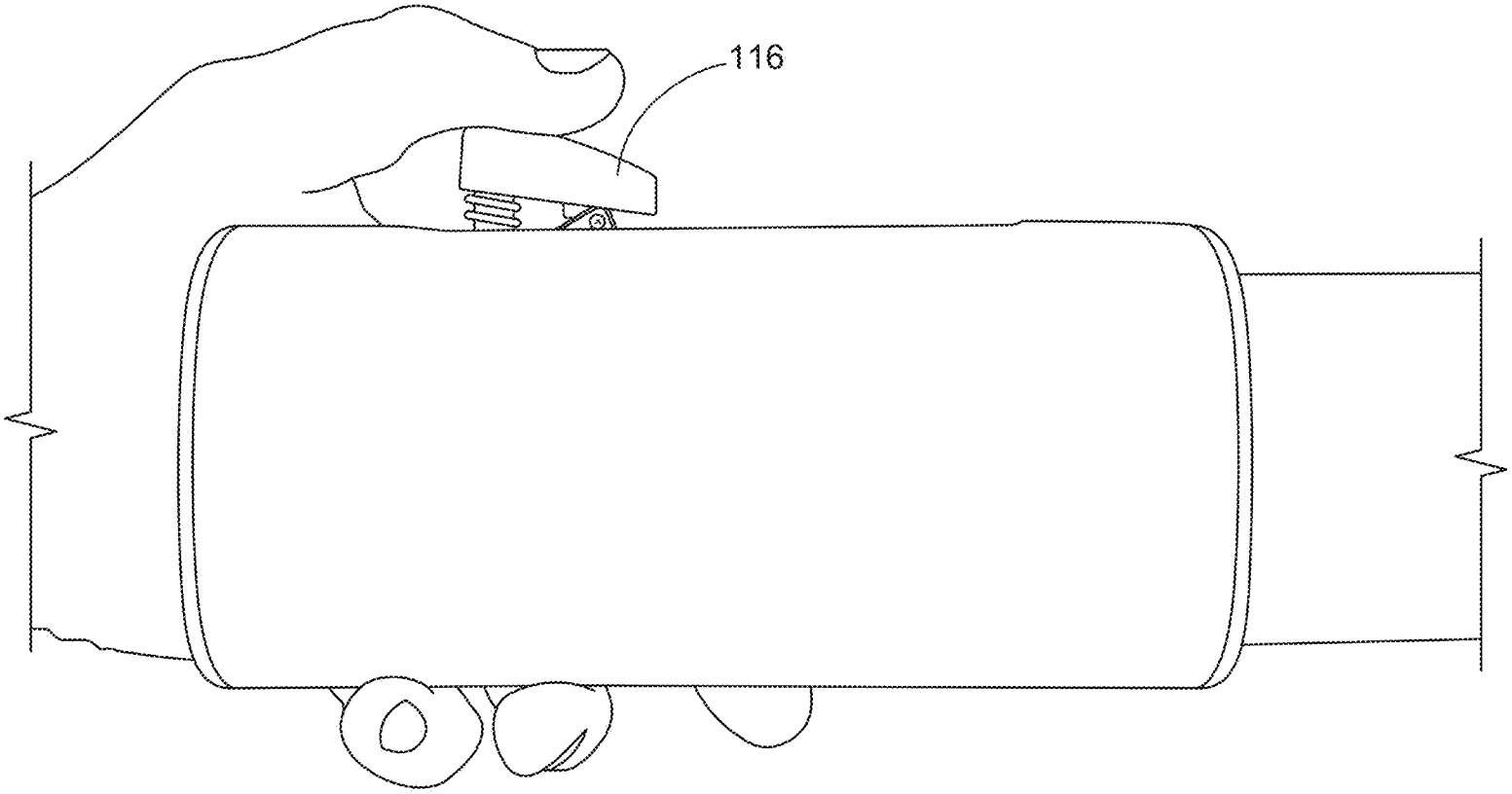
FIG. 3B illustrates an embodiment of a lever style telescoping control button.

FIG. 3B illustrates an embodiment of a lever style telescoping control button. The end of an outer tube closer to the body of the trainer is shown. In this example, a side view of a lever style telescoping unlock button 116 is shown.

Figure 4A:
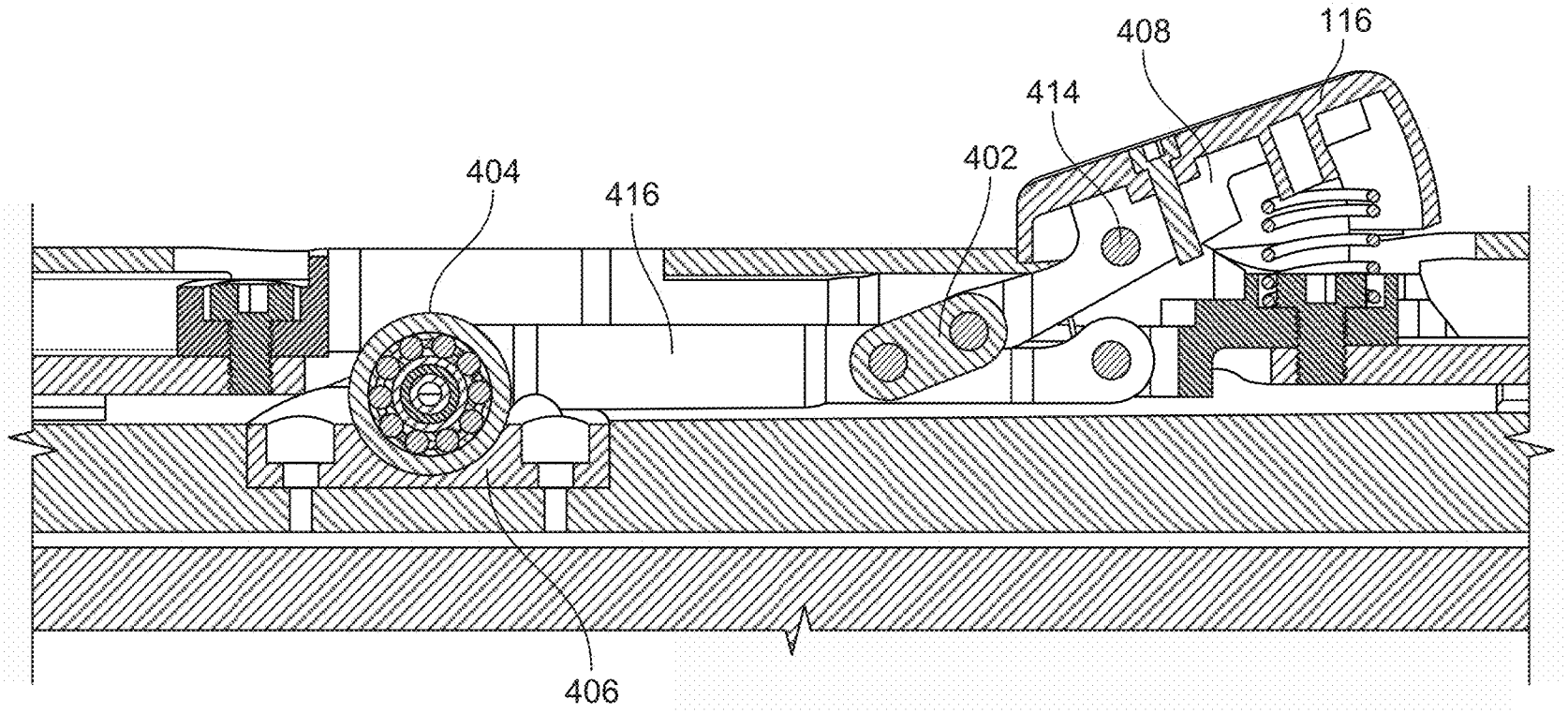
FIG. 4A illustrates an embodiment of a telescoping unlock mechanism.

FIG. 4A illustrates an embodiment of a telescoping unlock mechanism. In this example, the mechanism of FIG. 4A underlies an angled button such as the angled button 116 shown at FIGS. 3A and 3B. In this example, the body of the trainer is towards the left of the image. Shown in this example is a four bar linkage that has an over-center element 402 that locks the telescoping in place. In this example, the button is shown not being pressed and in an upward position, where the positon of the telescoping (e.g., where the outer tube is relative to the inner tube) is locked.

Figure 4B:
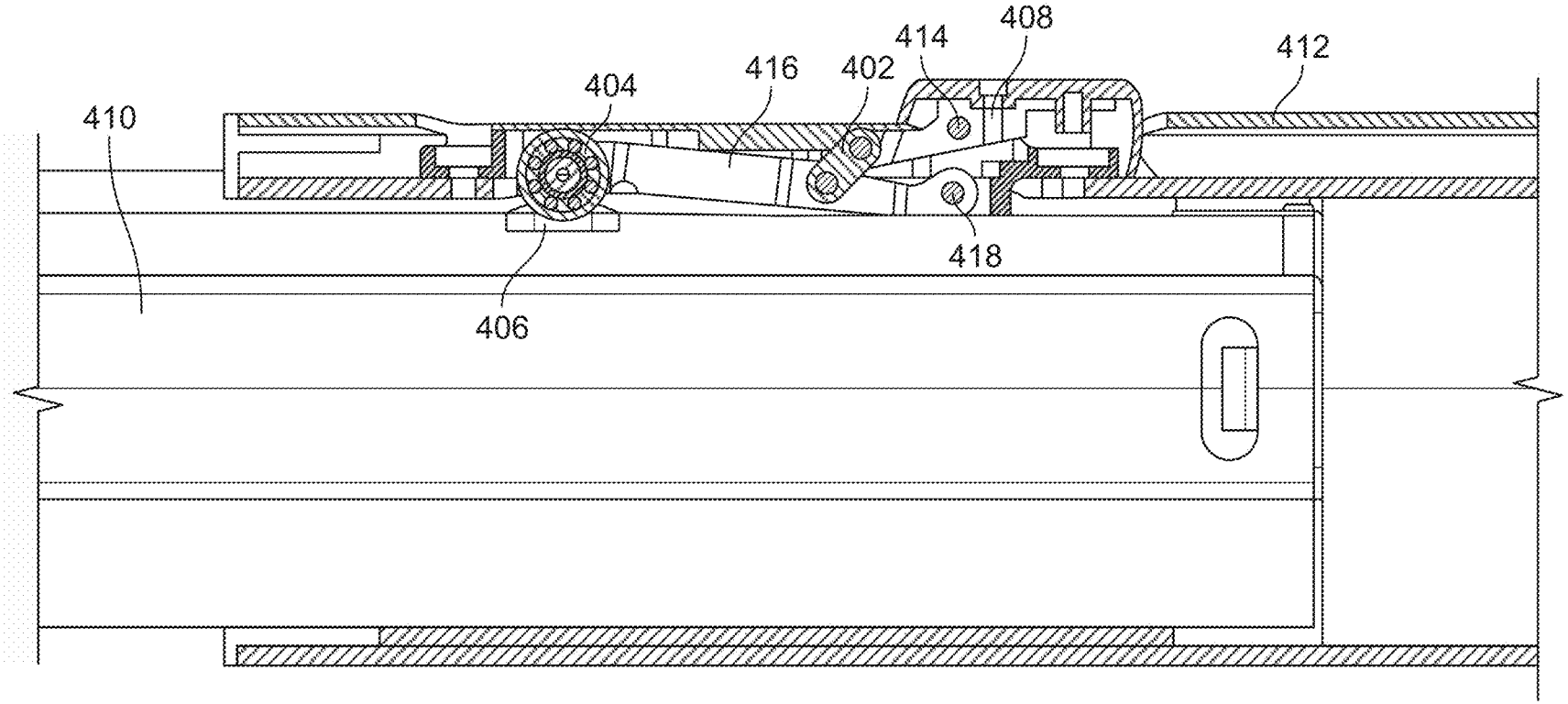
FIG. 4B illustrates an embodiment of a telescoping unlock mechanism.

FIG. 4B illustrates an embodiment of a telescoping unlock mechanism. In this example, the lever-style button of FIG. 4A is shown, but in a depressed state (where, for example, the user has pressed down on the lever button). In this example, the inner tube is shown at 410, and the outer tube is shown at 412

Using the mechanism shown in FIGS. 4A and 4B, the telescoping is locked between the inner tube and the outer tube. For example, referring to the example of FIG. 4A, using this mechanism, the telescoping is locked by lowering the wheel 404 into a hole 406 in the inner tube. Referring to the example of FIG. 4B, the telescoping is unlocked by raising the wheel 404 out of the hole 406. The wheel allows a smooth action/motion when sliding the outer tube over the inner tube (e.g., along track 206 of FIG. 2). The use of the wheel further reduces marking of the inner tube when sliding the outer tube.

In some embodiments, the inner tube includes a set of holes that the wheel can be lowered into, providing discrete points along the inner tube at which telescoping can be locked between the inner tube and the outer tube. For illustrative purposes, the arms have two telescoping positions, either fully retracted or fully extended (and thus two corresponding locking holes). The number of telescoping positions may be changed by increasing the number of locking holes in the inner tube.

The following is an example of unlocking the telescoping of the arm described herein. Referring to the examples of FIGS. 4A and 4B, starting from the unpressed state shown in FIG. 4A, the user presses down the lever-style button. As shown in the example of FIG. 4B, pressing of the lever-style button causes part 408 to rotate around point 414. Rotation of part 408 about point 414 in turn causes linkage 402 to invert, which in turn pulls up component 416, which rotates around point 418, causing the pin wheel 404 to be pulled out of the hole 406 in the inner tube 410.

While the user holds the lever-style button down, the outer tube is unlocked from the inner tube, and the user is able to move the outer tube, for example, to the next hole (either for retracting or extending), which will cause the wheel pin to drop into that next hole, where the lever will then pop back up. This gives the user an indication that a telescoping position hole has been reached. When the user releases the lever-style button when the wheel 404 is over a telescoping indexing hole such as indexing hole 406, this causes the wheel/roller to be lowered into the hole.

Figure 4C:
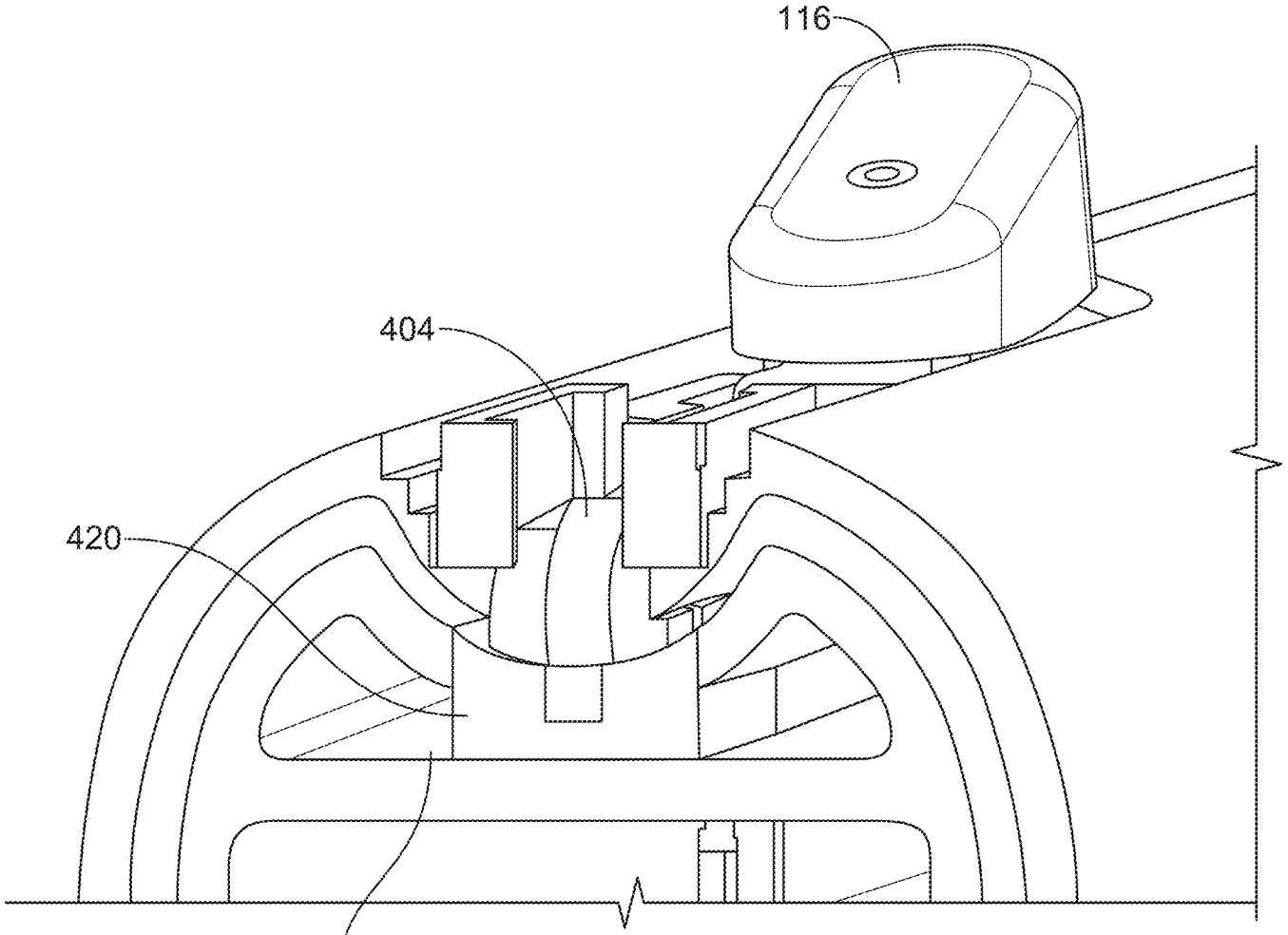
FIG. 4C illustrates an embodiment of a locking telescoping position of an arm.

FIG. 4C illustrates an embodiment of a locking telescoping position of an arm. In this example, a cross-section view of the telescoping unlock mechanism of FIGS. 4A and 4B is shown. In this example, the wheel/roller 404 is inside of a hollow pin 420 that is in a hole 406 in the inner tube for locking the outer tube to the inner tube. Once the user extends the arm, the roller falls into a hole. As shown in this example, in order to raise the roller out of a hole, the user presses the lever-style button 116, as described above.

Figure 4D:
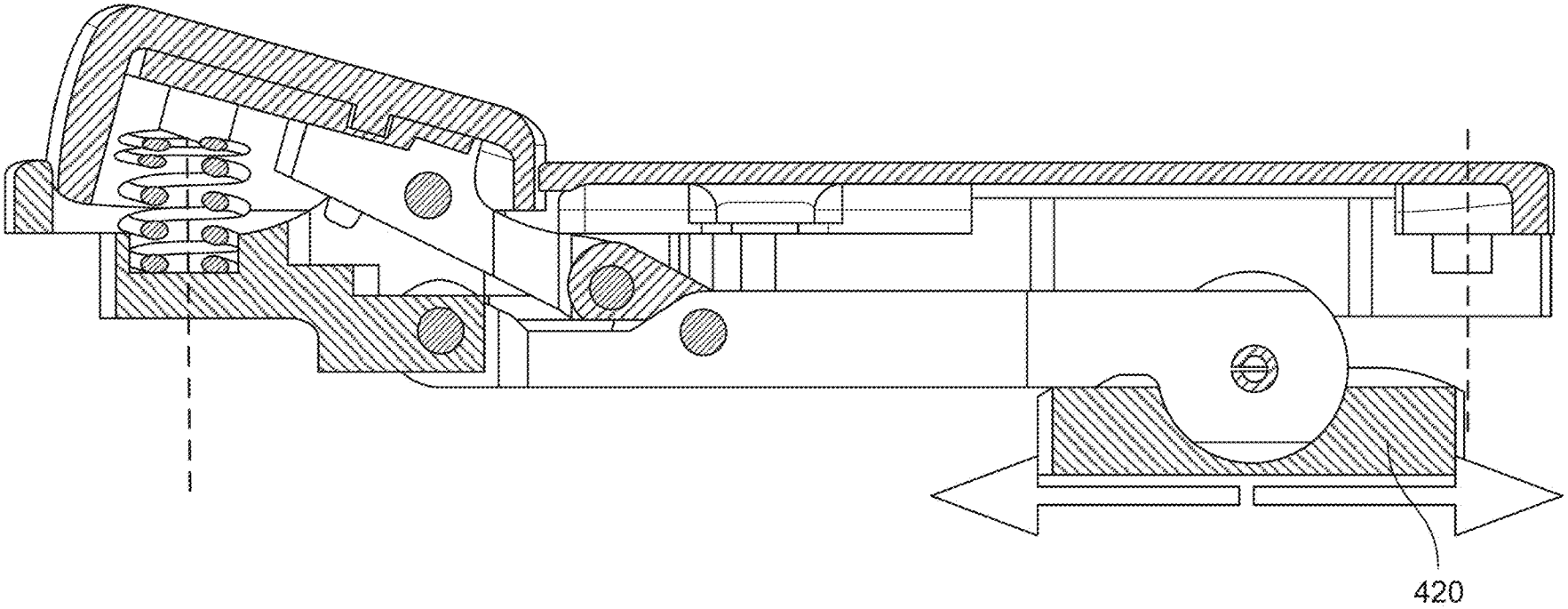
FIG. 4D illustrates an embodiment of an arm in a locked telescoped position.

FIG. 4D illustrates an embodiment of an arm in a locked telescoped position. A side profile view of the housing 420 around the roller is shown.

Figure 5:
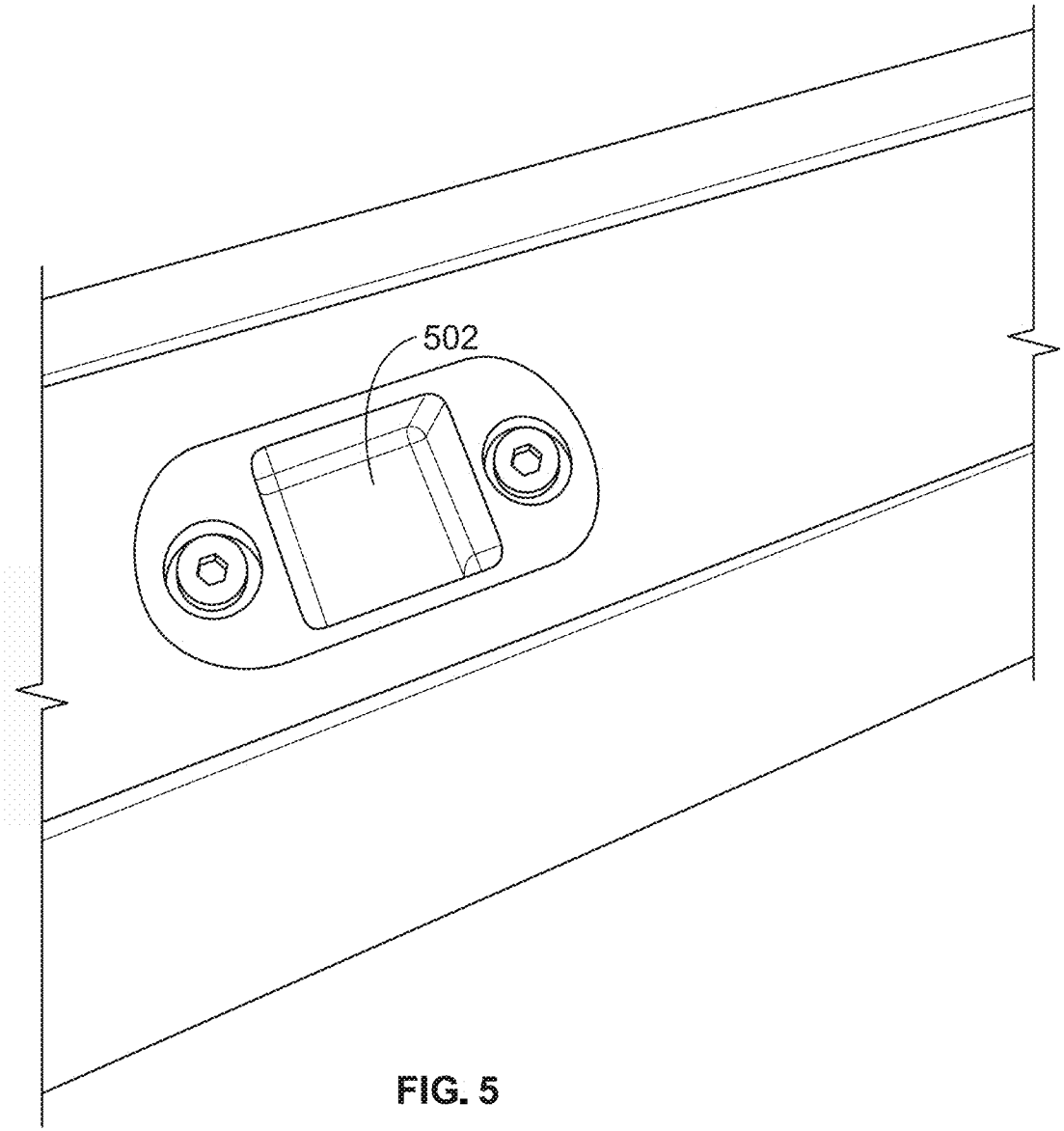
FIG. 5 illustrates an embodiment of a telescoping position locking hole.

FIG. 5 illustrates an embodiment of a telescoping position locking hole. A squared off locking hole in an inner tube is shown at 502. The use of a squared-off locking hole prevents the roller (e.g., roller 404) from rolling out of the locking hole.

In some embodiments, the lever-style locking mechanism described above provides double locking. For example, in the four bar linkage described above, the over-center linkage 402 provides double locking. The over-center linkage prevents the telescoping from being back-drivable (e.g., provides a secondary locking mechanism that prevents the roller from coming out of the slot in the inner tube due to the movement of the arm during normal use of the exercise machine). In some embodiments, actuating the lever is a two-action lever pull. Referring to the example of FIG. 4A, where the telescoping position is locked, because of the over-center linkage 402, the lever with roller (combination of roller 404 on lever 416) cannot be pushed directly out of the locking hole 406 unless the button 116 unlocks the lever 408.

In the above examples, the control unlocking arm telescoping is located at the same place as where the locking of the outer arm and inner arm occurs.

As shown above, the lever/angled control is a single-handed telescoping unlock mechanism. As shown in the above examples, the button lever is placed on the same side of the arm where the user can access the control and actuate it. For example, the user can grip and press at the same time to perform the unlocking action.

Further, the placement of the lever control at the end of the outer tube closer to the body of the trainer allows the control that is activated by the user to unlock arm telescoping to be accessible in various arm configurations (e.g., various combinations of pivot angle and telescope position). In this way, the controls are designed to be accessible from multiple hand positions, whether the arms are up or down, where the controls may be activated in a single-handed manner in a variety of grip positions. For example, by placing the telescoping control at the portion of the outer moving tube that is closer to the body of the trainer, the control will be at the base of the trainer (e.g., close to the shoulder joint) when the arm is fully retracted, or at the middle point of the overall arm (also referred to herein as the "elbow") when the arm is fully extended and telescoped out. In this way, even when the arm is fully extended and vertically pointed upward, the user is still able to access the telescope control, as it will still be at the elbow (e.g., roughly middle) of the extended arm (versus, for example, placing the control at the wrist of the arm, which may be too high for a person to reach when the arm is extended and pointing upwards, thereby making it difficult for them to unlock the telescoping).

Further, by designing the outer tube to be the portion of the arm that moves, and placing the control on the outer arm, the locking mechanism (e.g., pin or wheel) is local to where the user action/interaction with the control takes place (e.g., where the user presses the button). That is, where the user activates the control is close to where the actual mechanical locking/unlocking occurs.

By designing the controls to allow for single-handed manipulation, as described above, symmetric interactions are facilitated, where a user can adjust the telescoping of both arms at the same time.

Further, by making the outer tube the tube that moves, the controls may be placed on the exterior of the arms so that they are always accessible to the user regardless of how the arms are telescoped. In various embodiments, different control points may be placed at different locations of the arm, where the user can access the controls to extend or retract in the multiple locations.

In some embodiments, as it is the outer tube that is moving, the base (shoulder) and/or inner tubes of the arms are strengthened to support the larger moment arm when the outer tube is extended (and the arm is lengthened). For example, when the arm is fully extended as shown in the example of FIG. 1D, the arm is most likely to snap at the base (shoulder) of the trainer. In some embodiments, the shoulder joint is designed to be strong enough to resist the force and torque resulting from the arm (e.g., based on a particular section and material selection).

While embodiments of a telescoping arm in which an outer tube moves relative to the inner arm are described herein, in other embodiments, the outer arm is fixed (e.g., to the body of the trainer), and it is the inner arm that moves relative to the outer arm (where controls may be placed, for example, on a wrist end of the arm so that they are always accessible to the user, regardless of whether the arm is retracted or extended).

Arm Rotation

In some embodiments, the vertical pivot point is at what is referred to herein as the "shoulder" of the exercise machine (e.g., shoulders 112 and 114). As shown in the examples of FIGS. 1A-1F, the arms rotate about the shoulder joint.

Pivot Control Placement

Figure 6:
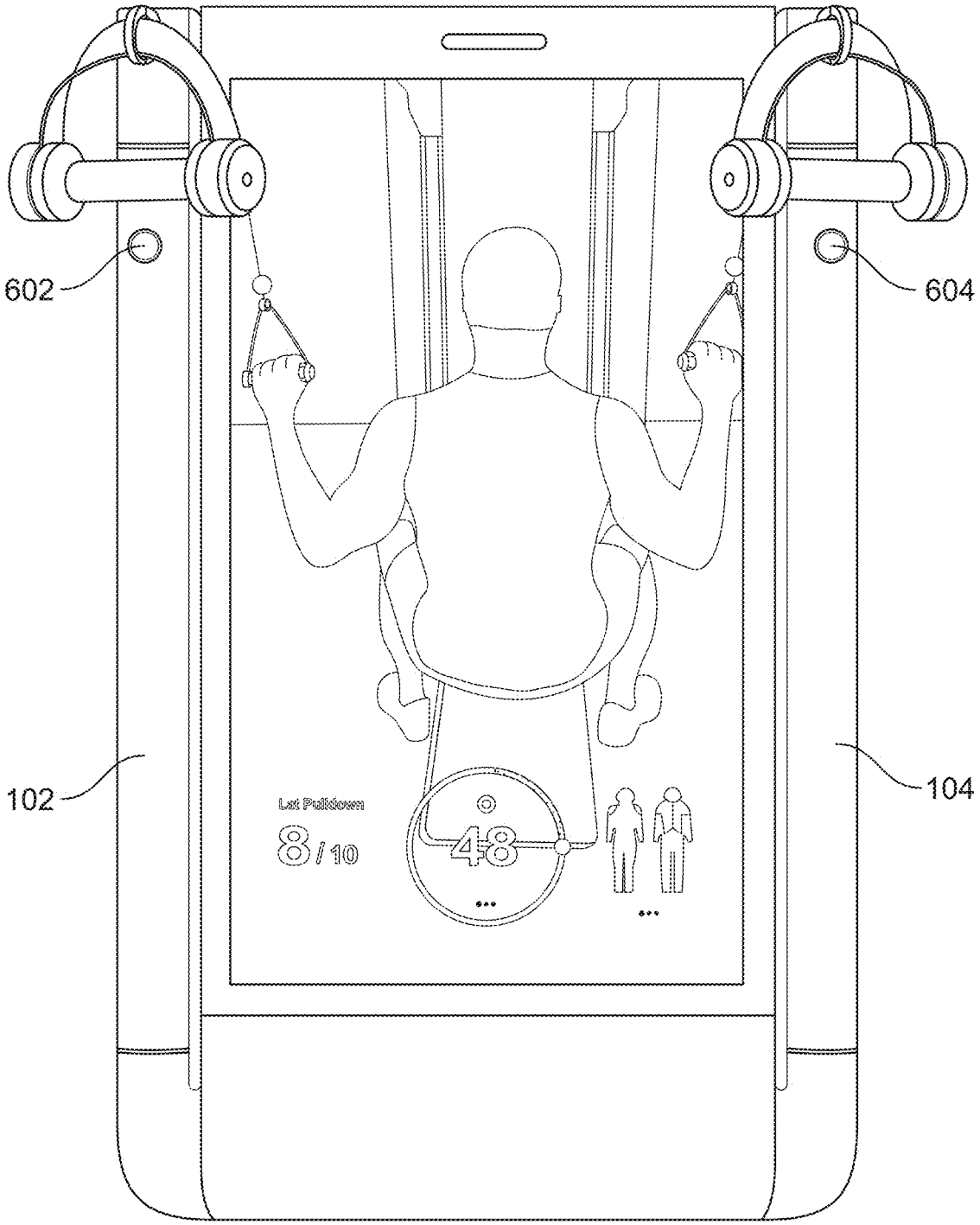
FIG. 6 illustrates an embodiment of an exercise machine.

FIG. 6 illustrates an embodiment of an exercise machine. As shown in this example, a button 602 is placed on the arm to control locking and unlocking of the vertical pivoting degree of freedom for the arm. Button 602 is an example of vertical pivot unlock button 120 of FIG. 1A. Pivoting control buttons are shown at 602 and 604 on arms 102 and 104, respectively.

Figure 7:
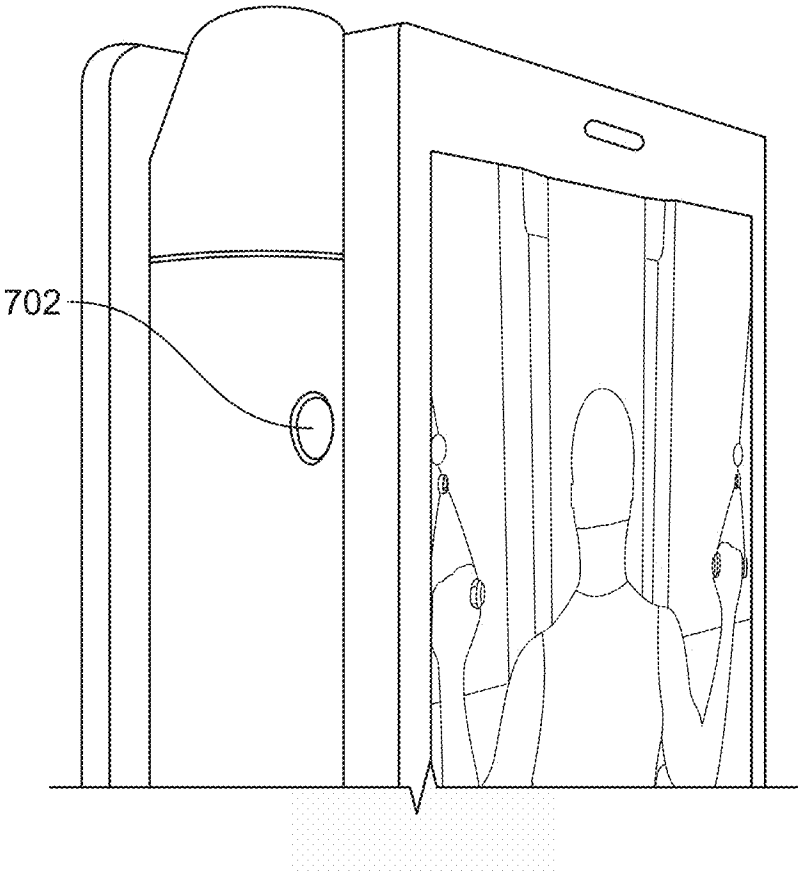
FIG. 7 illustrates an embodiment of a portion of an exercise machine.

FIG. 7 illustrates an embodiment of a portion of an exercise machine. In this example figure, a closeup on the pivot DOF release button is shown at 702. While the pivot release button is shown to be on the portion of the arm facing the user when the arm is stowed, the pivot release button may be placed at other locations on the arm. For example, the pivot release button may be placed on the opposite side of the arm, as shown in the example of FIG. 1C, where pivoting control button 122 is on the top of the arm and faces away from the user and towards the wall when the arm is stowed.

When the pivot control button is pressed, the shoulder joint is unlocked, allowing the user to rotate the arm about the shoulder joint.

In some embodiments, a soft (software) button or control is provided on the display (a physical button on the body may also be provided) that a user may press to unlock the vertical pivot/rotation. This is one example of a mode that provides improved accessibility for users to reach.

Transmitting User Input to Rotation Lock Mechanism

In this example, the button or control for arm rotation is remote from where the rotation locking actually occurs. For example, the arm rotation control button may be placed on the arm, while the arm rotation locking mechanism is at the shoulder of the exercise machine (further details regarding the rotation lock mechanism are described below). Further, because the arm is telescoping, the distance between where the pivot unlock button is and where the actual unlocking occurs (at the shoulder joint) will vary—this is accounted for in the below mechanisms for collecting user input to unlock the arm rotation, and causing the arm rotation lock mechanism to unlock.

The following are embodiments of techniques for transmitting or conveying a user input and intent to unlock/lock (e.g., by pressing or releasing the arm rotation button) to the rotation lock mechanism to cause locking/unlocking of the arm rotation (where the rotation lock mechanism is physically distant from the user control). In some embodiments, the techniques for transmitting or conveying the unlock signal (caused by the user interacting with the arm rotation control on the arm) to the rotation locking mechanism take into account that the arm telescopes and has an outer tube that moves and slides relative to an inner tube. For example, as will be shown in the embodiments described below, the rotation control, which is on the outer arm, need not be physically connected to the inner arm, which is connected to the shoulder rotation. Rather, the user's activation of the rotation control may be sensed at a distance from where the unlocking of the rotation mechanism occurs.

IR (Infrared) Reflector

In this example, when the user pushes the rotation control button, this user activation of the control causes a reflector (e.g., a reflective surface such as a mirror) to be exposed. An IR emitter-receiver pair sees the reflector (based on the IR being emitted now being reflected back to the receiver to the reflective surface being exposed). Detection of the reflected light is an indication or signal that the arm rotation control has been activated by the user.

In some embodiments, the IR emitter-receiver pair is internal to the arm. As one example, the IR emitter-receiver pair is in the inner arm/tube, where the IR emitter-receiver pair is then electrically connected into the system (e.g., the body of the trainer) through the shoulder. In this case, there is no electrical connection between the inner arm (with the IR emitter-receiver pair) and the outer arm (which has the reflective surface and the arm rotation control button).

In this example, the IR emitter is projecting IR light down the arm (where the IR emitter is continuously shining light down the arm and the receiver is waiting for the reflective surface to be exposed). When the user presses the arm rotation control button, this action causes a reflective surface to be uncovered/exposed, which then reflects back the light being shined by the IR emitter. The IR receiver detects the reflected-back signal, indicating that the arm rotation control was pressed, and that a signal should be sent to the shoulder to unlock arm rotation.

This design accommodates the telescoping aspect of the arm, where the arm control button (which moves with movement of the outer arm) does not need to be electrically physically connected to the inner arm (where the IR emitter-receiver pair is located). Here, the emitter-receiver pair is lined up with where the reflective surface is when exposed. The reflected light may be detected regardless of where the outer arm is relative to the inner arm.

In some embodiments, the rotation locking mechanism is in the shoulder joint. In some embodiments, the IR emitter-receiver pair is placed at the end of the inner arm furthest away from the body of the trainer, and an electrical connection is made from the shoulder to the end of the inner arm. This allows the IR emitter-receiver pair to be close to the reflective surface when the arm is in the fully retracted state, and only separated by the retraction distance in the extended state. This may also reduce the possibility of interference by other components within the arms, such as the cable running through the arms.

In another embodiment, the IR emitter-receiver pair is placed at the shoulder joint. This may reduce the amount of wiring running from the shoulder joint to the end of the inner arm.

In this example, exposing of the reflective surface by pressing the arm rotation control may be done mechanically, without requiring electronics at the rotation control button.

While in the above examples the reflective surface was exposed in response to activation of the button, in other embodiments, the reflective surface is hidden.

Bluetooth

In another embodiment, pressing of the arm rotation control causes a wireless signal such as a Bluetooth signal to be transmitted, which is registered and detected by a corresponding receiver, which then provides a signal to unlock the shoulder rotation mechanism. In some embodiments, this includes placing electronics as well as a battery at the location of arm rotation control on the outer tube.

Inductive Sensing

In some embodiments, an inductive circuit is used, where the inductance of a ring is changed when a user activates the arm rotation control. The change in inductance is wirelessly sensed, where the rotation lock mechanism is then unlocked in response.

In one embodiment of the inductive design, the ring is implemented as a coil of traces. The ring is connected via additional traces back to a switch (e.g., the arm rotation control button). When the switch is open, the circuit including the coil is open. When the user presses the switch, the circuit is closed. Here, the closing of the circuit by activating the switch does not require active electronics (e.g., no batteries, no current flow, etc.).

In some embodiments, a second coil is placed in the inner arm in proximity to (e.g., under) the coil attached to the arm rotation control switch. A waveform (e.g., sine wave) is excited in the second coil. When the coil attached to the rotation control switch is closed or opened (based on the user hitting the switch), this impacts the response of the sine wave in the second coil, which is detected by a microcontroller. The microcontroller then determines whether the arm rotation control is open or closed. Here, active electronics only need to be placed on the inner arm, where at the outer arm active electronics are not needed as the rotation control is opening or closing a switch. As one example, the arm rotation control button is implemented using a tact switch, which closes or opens the coils.

Figure 8A:
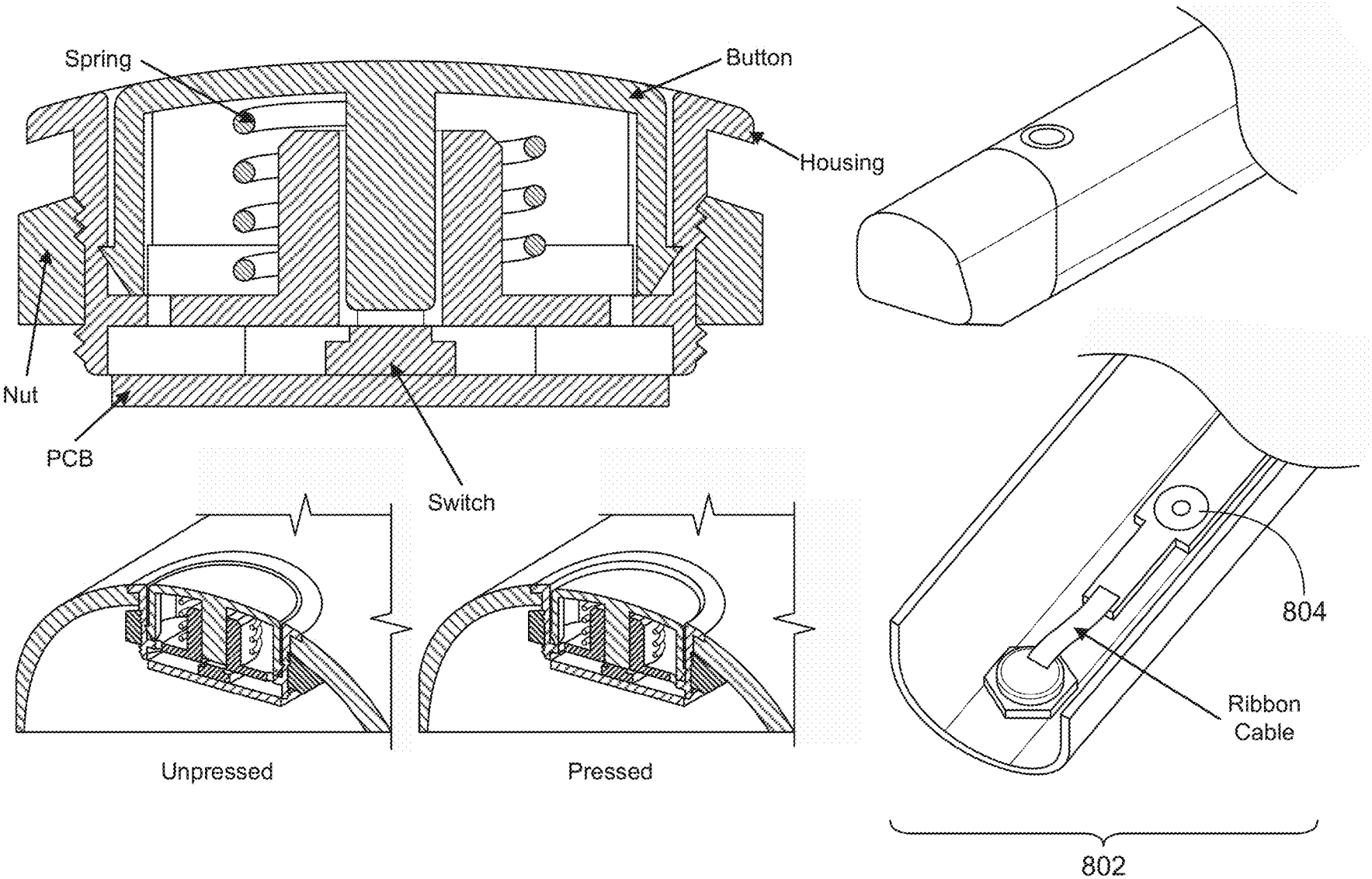
FIG. 8A illustrates an embodiment of a button switch for inductive arm rotation control.

FIG. 8A illustrates an embodiment of a button switch for inductive arm rotation control. An inner surface of the underside of the outer arm and the button is shown at 802. The coil attached to the arm rotation control switch is shown at 804.

Figure 8B:
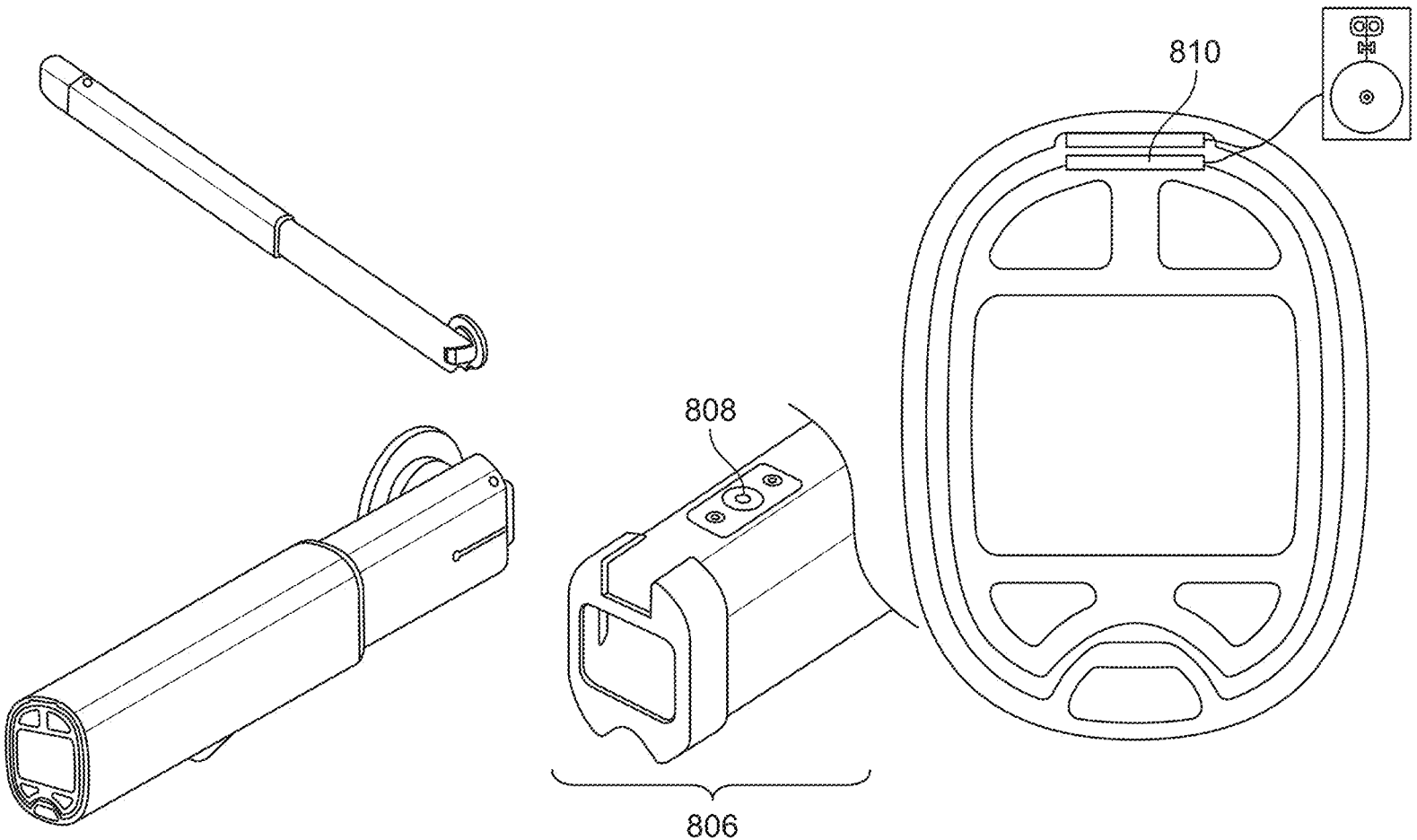
FIG. 8B illustrates an embodiment of inductive sensing.

FIG. 8B illustrates an embodiment of inductive sensing. A portion of an inner arm of the telescoping arm is shown at 806. A coil on the inner arm is shown at 808. Overlap of the coil on the outer arm (e.g., coil 804) with the coil on the inner arm (e.g., coil 808) is shown at 810.

Figure 9A:
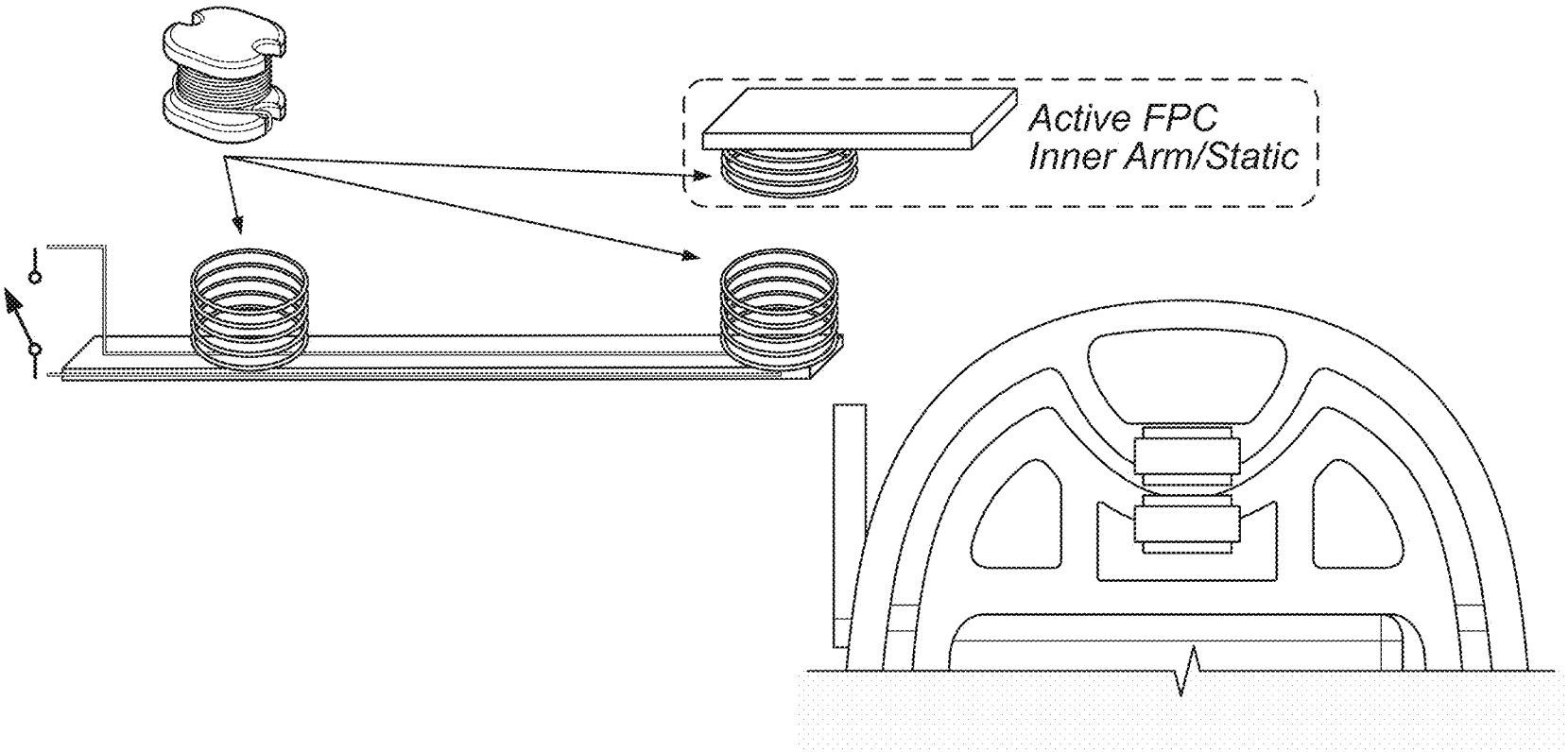
FIGS. 9A and 9B illustrate another embodiment of an inductive sensing mechanism for detecting user activation of a control for unlocking arm rotation.
Figure 9B:
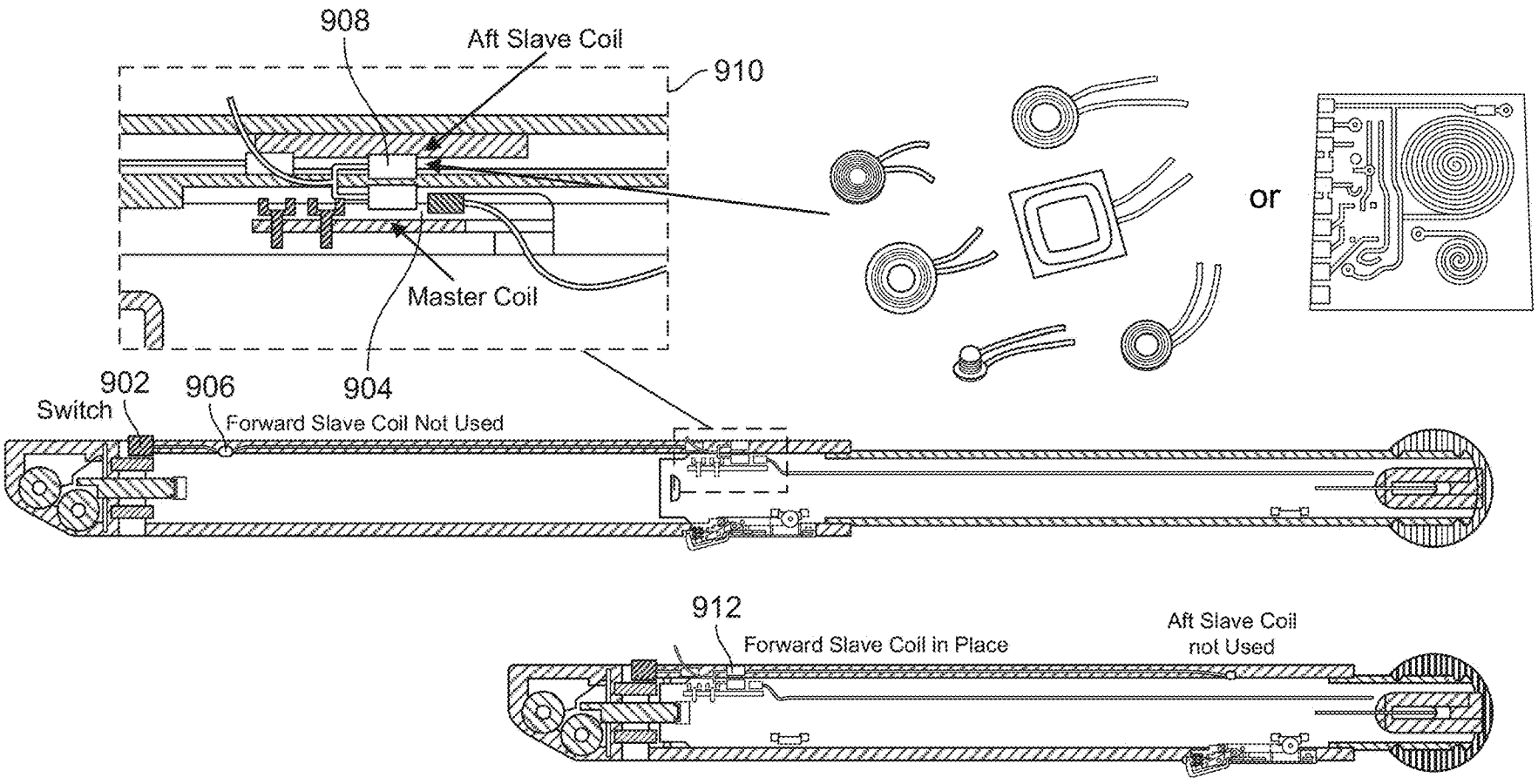

FIGS. 9A and 9B illustrate another embodiment of an inductive sensing mechanism for detecting user activation of a control for unlocking arm rotation. A non-power inductive circuit is shown in FIG. 9A. In the example of FIG. 9B, an arm rotation control switch on the outer tube of the telescoping arm is shown at 902. A master coil in the inner arm is shown at 904. In some embodiments, the master coil 904 is an example of coil 808 of FIG. 8B. The switch is connected to a forward slave coil 906 and an aft slave coil 908 of the outer arm. In some embodiments, the two slave coils on the outer arm correspond to two telescoping positions (e.g., fully retracted and fully extended). In this example, as shown at 910, when the telescoping arm is fully extended, the aft slave coil of the outer arm is in place over the master coil of the inner arm (and the forward slave coil is not used). In this example, as shown at 912, when the telescoping arm is fully retracted, the forward slave coil 906 is in place over the master coil 904 of the inner arm (and the aft slave coil 910 is not used). In this way, the user's activation of the arm rotation control may be detected in either the retracted or extended telescoping positions. In this example, the inductive coils are used to alter the response of a resonant filter circuit. For example, when the user presses the button, pressing of the button causes a magnet to move through a coil, inducing a current. That current then flows into another coil, and is sensed. This provides another wireless electromechanical embodiment where a current is induced and sensed. The configuration shown in FIGS. 9A and 9B provides a no-contact solution that has minimal mechanical complexity.

Figure 9C:
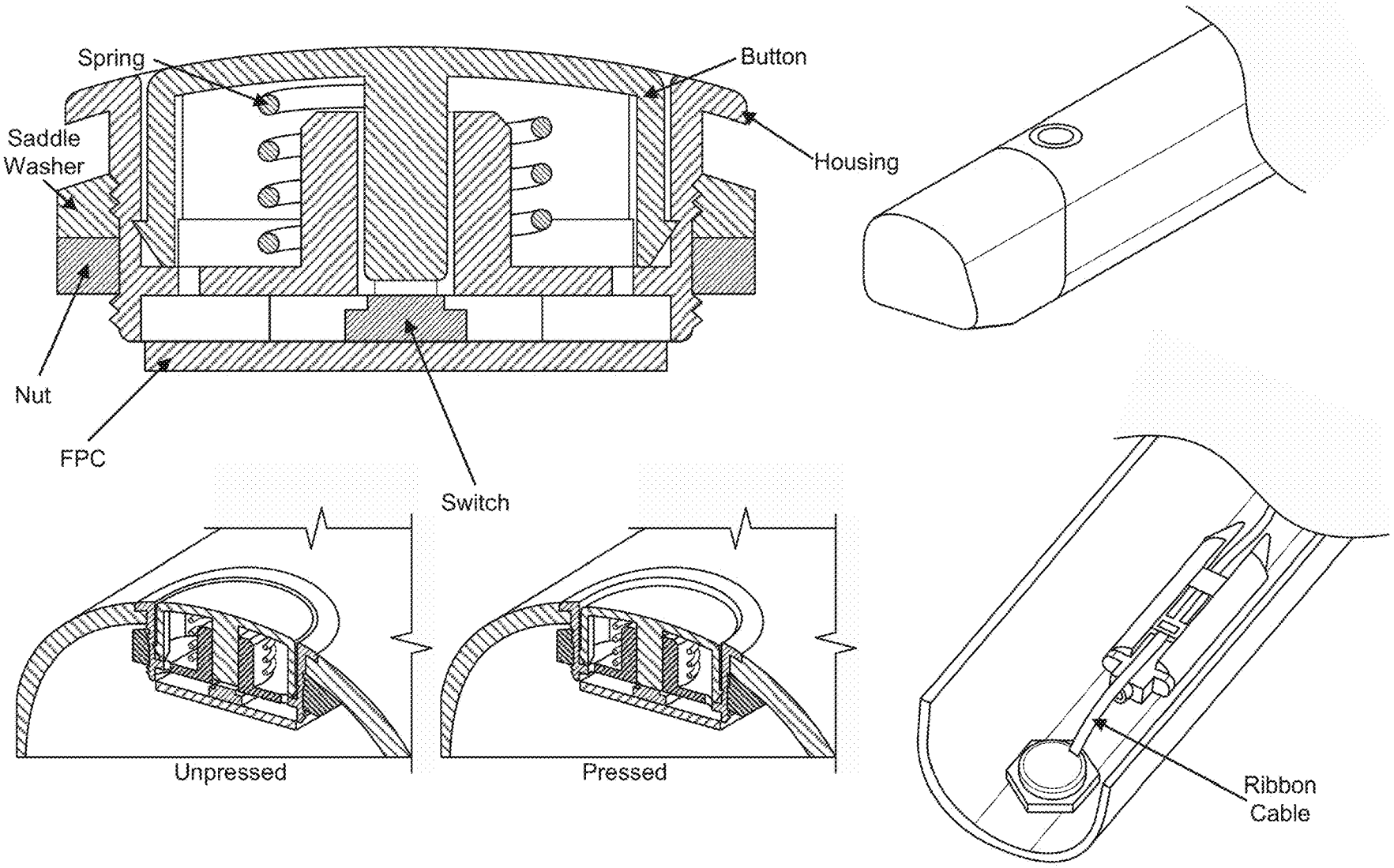
FIG. 9C illustrates an embodiment of a button usable for the inductive sensing described in the example of FIGS. 9A and 9B.

FIG. 9C illustrates an embodiment of a button usable for the inductive sensing described in the example of FIGS. 9A and 9B. In some embodiments, a low-throw tactile switch design is used. In some embodiments, a circuit board is included with a ribbon cable to adapt to other PCBs (e.g., with the slave coils in the outer arms described above). In some embodiments, the button design shown in FIG. 9C may be used for embodiments involving spring fingers.

Magnetic Sensing

In another embodiment, pressing the arm rotation control button moves a magnet, where the moving of the magnet is sensed. In response to detection of the moving of the magnet, the rotation lock mechanism is unlocked. In some embodiments, the magnetic sensing mechanism is implemented using a cable-actuated Hall-effect sensor, as will be described in further detail below.

In this example, when the user activates the arm rotation control button, this action causes a cable to be pulled. Pulling of the cable causes a magnet in the outer arm to move. The magnet in the outer arm moves over a sensor such as a Hall-effect sensor that is in the inner arm. In this example, electronics need not be in the outer arm (where the moving of the magnet is done mechanically using the cable). The movement of the magnet causes changes in the output of the Hall-effect sensor, which is used to determine whether the user has pressed the arm rotation control button and whether to unlock the arm rotation lock mechanism.

Figure 10A:
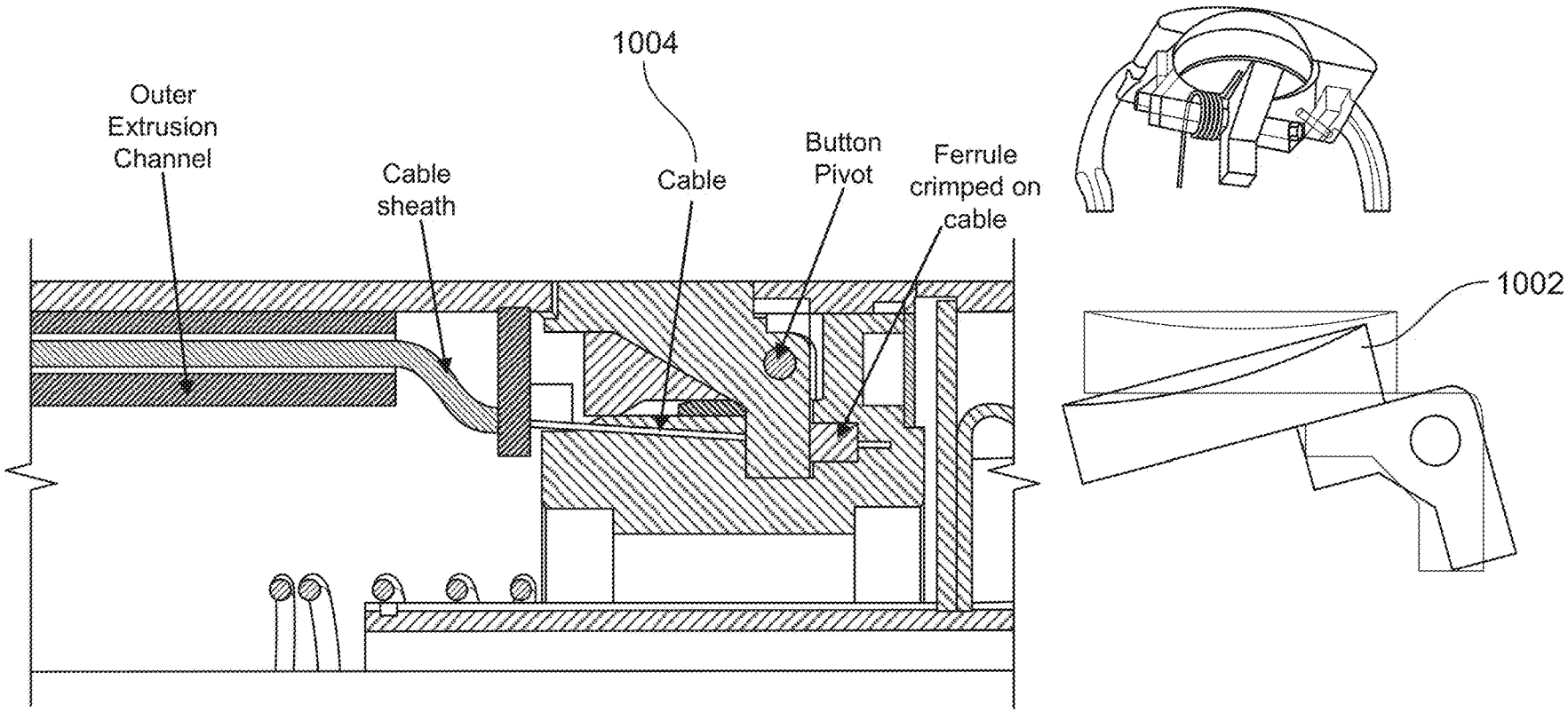
FIGS. 10A and 10B illustrate embodiments of cable actuated Hall-effect mechanisms.
Figure 10B:
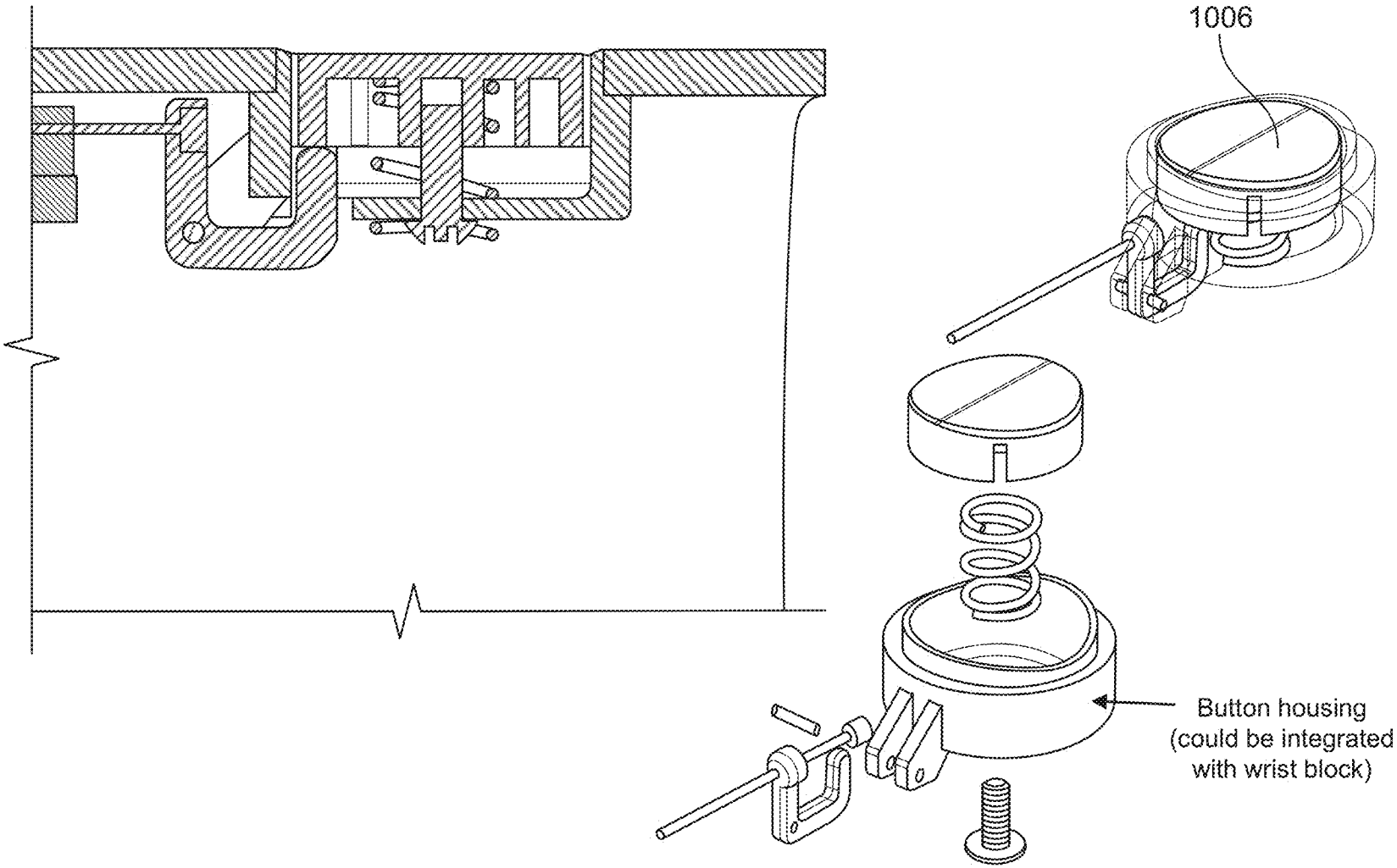

FIGS. 10A and 10B illustrate embodiments of cable actuated Hall-effect mechanisms. In the example of FIG. 10A, a pivoting button is shown, where the rotation of the pivoting button 1002, when pressed, directly pulls on a cable 1004, which causes the magnet described above to move. In the example of FIG. 10B, a cable actuated push-button mechanism is shown. In this example, translation of the button 1006 causes a rocker arm to move, which causes a cable connected to the magnet to move. In another embodiment, a slider button is used to move the cable back and forth.

Electrical Service Loop

In another embodiment, the arm rotation control button is physically connected to the rotation lock mechanism via, for example, a wire. As one example, the wire is a cord that is able to expand and contract (to account for change in arm length due to telescoping). Pressing a button closes or opens a circuit, where the opening/closing of the circuit is detected and is used to determine whether to unlock the arm rotation mechanism. In one embodiment, a coiled cable (e.g., telephone style cable) constrained in a tube is used as the service loop.

Two-Position Spring Contact

Figure 11:
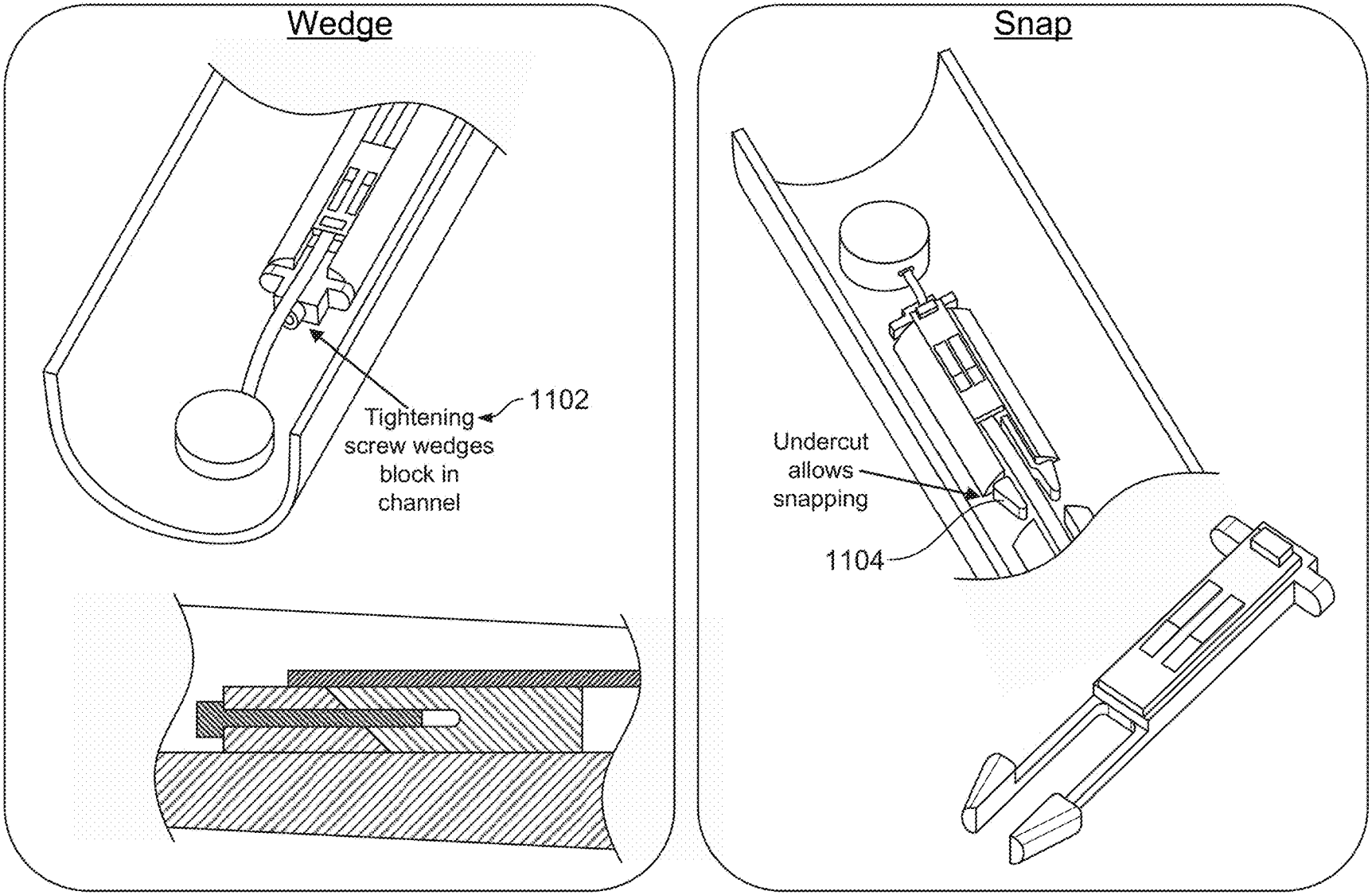
FIG. 11 illustrates embodiments of wedge and snap mechanisms for two-position spring contacts.

In one embodiment, two-position spring contacts are used, where there is a circuit board with contacts fixed to the outer arm. In some embodiments, a circuit is closed at both positions using the spring contacts. Snap and wedge mechanisms may be used. FIG. 11 illustrates embodiments of wedge and snap mechanisms for two-position spring contacts. A wedge mechanism is shown at 1102, where a tightening screw wedges a block in a channel. A snap mechanism is shown at 1104, where an undercut allows snapping.

In various embodiments of the arm rotation control described above, various types of switches may be used, such as piezoelectric switches, kinetic switches, etc.

Rotation Lock Mechanism

The following are embodiments of rotation lock mechanisms (for locking vertical pivoting of an arm). The rotation lock mechanisms described below may be unlocked in response to activation of the controls described above.

Figure 12A:
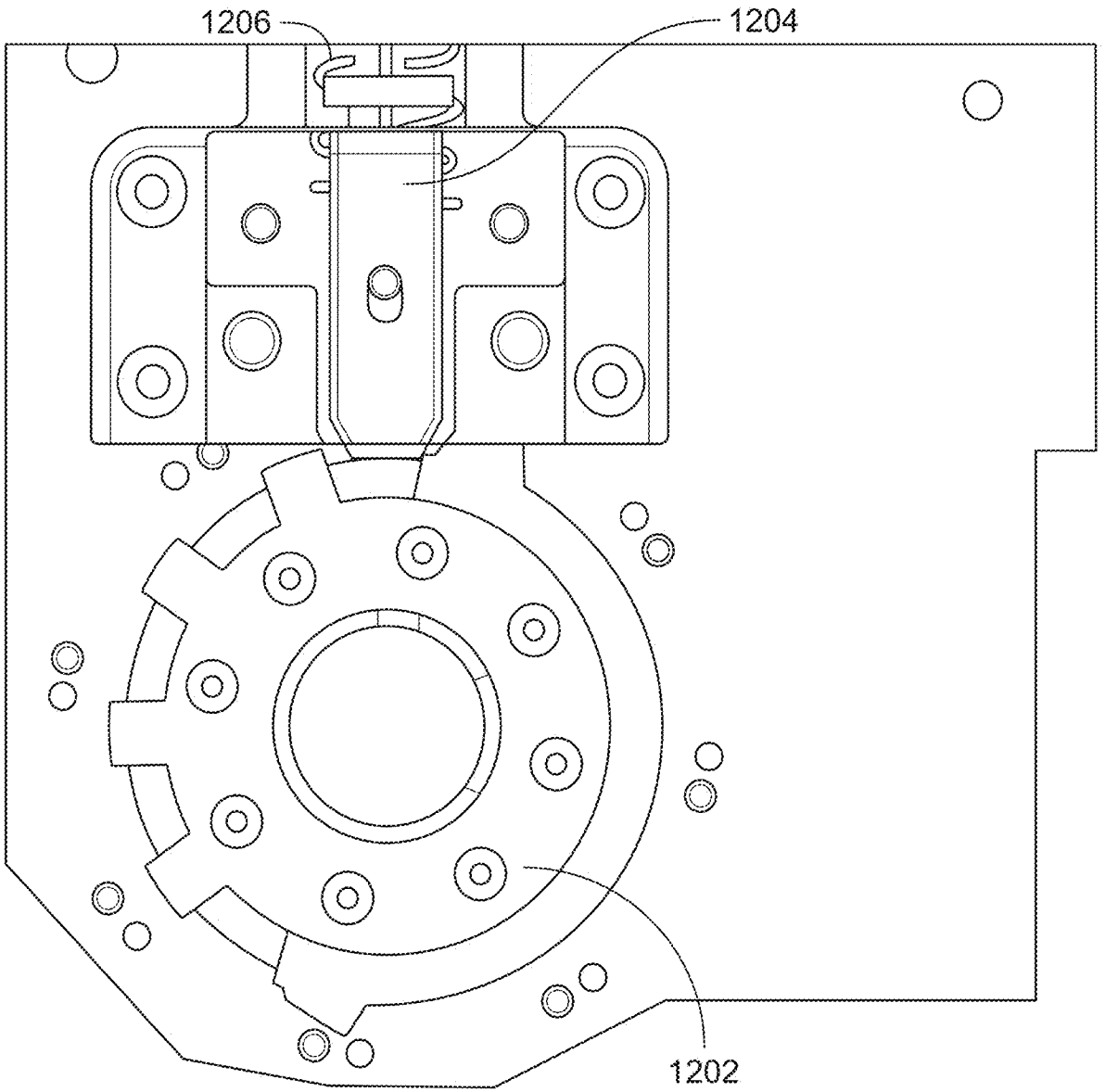
FIG. 12A illustrates an embodiment of a rotation lock mechanism.

FIG. 12A illustrates an embodiment of a rotation lock mechanism. In this example, gear component 1202 is attached to the shoulder of the trainer (e.g., shoulder 114 of FIG. 1A). In this example, component 1202 rotates with the arm. The remainder of the parts shown in this example are fixed to the frame of the trainer system (e.g., part of the body 106). The detents in the gear are the positions in which the arm may be locked. The detents are examples of keyways into which key 1204 drops. A spring 1206 pushes the key down. In this example, ball detents lock the key into place such that the key is not back-drivable, such that the pin (which has a wedge shape in this example and provides a tight fit with the angled faces of the gear component) is prevented from being pushed out during normal use of the exercise machine.

Figure 12B:
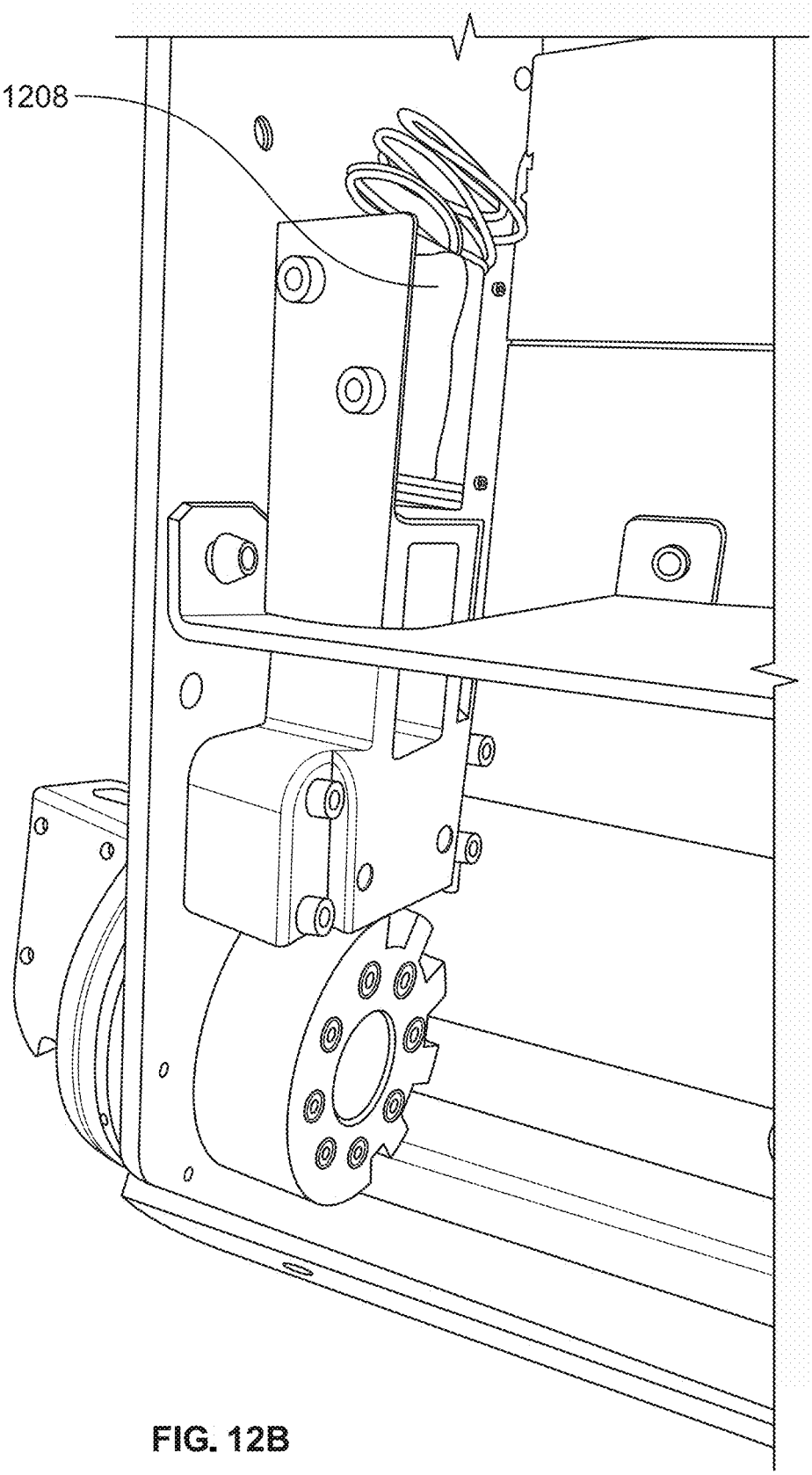
FIG. 12B illustrates an embodiment of a rotation lock mechanism.

FIG. 12B illustrates an embodiment of a rotation lock mechanism. In this example, an alternative view of FIG. 12A is shown. An electromechanical solenoid is shown at 1208. In this example, the solenoid behaves as a linear motor. In some embodiments, the solenoid is used in conjunction with the arm rotation control described above. The following is an example of unlocking an arm rotation lock with the IR reflector rotation control described above.

Figure 12C:
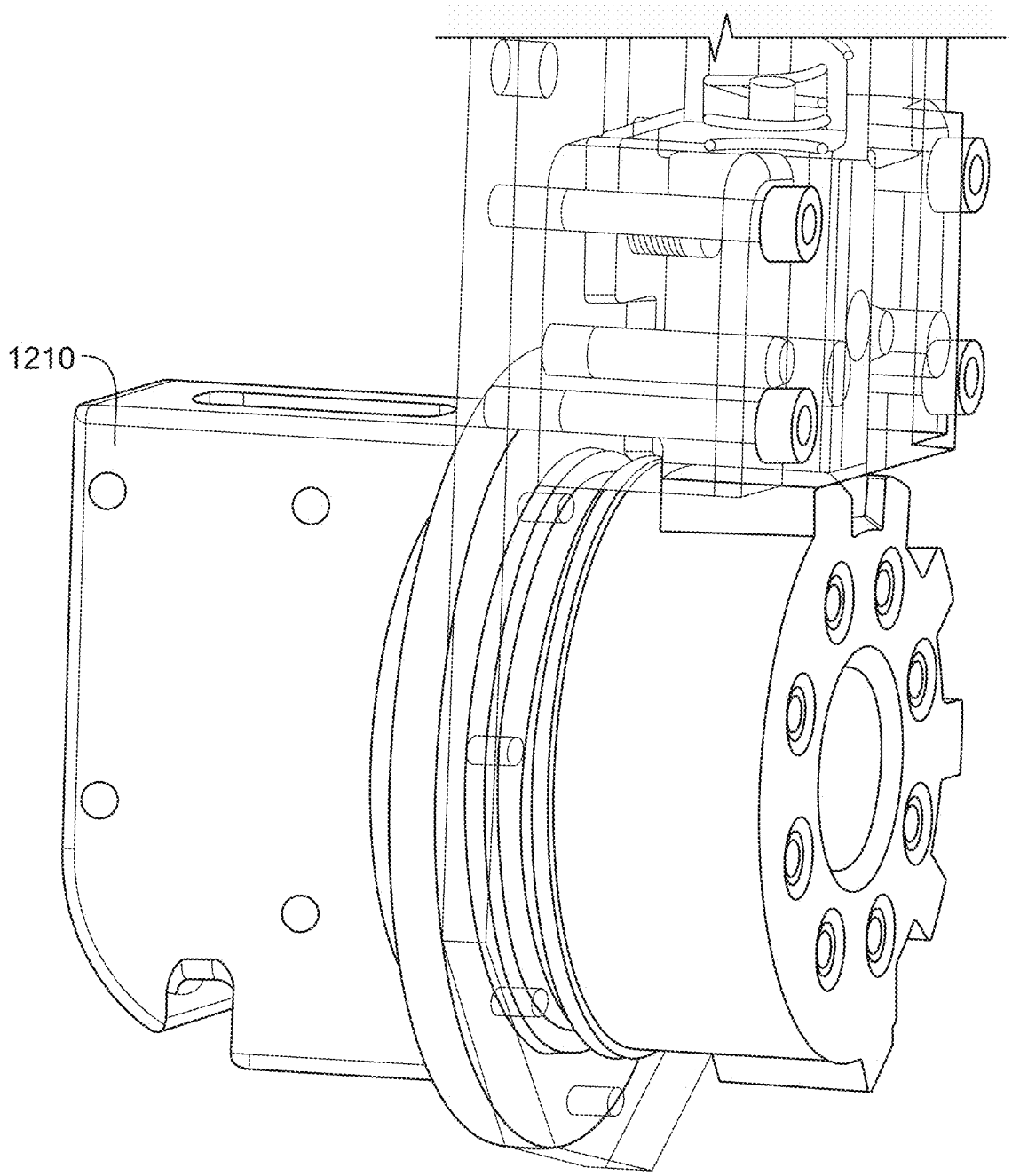
FIG. 12C illustrates an embodiment of a rotation lock mechanism.
Figure 12D:
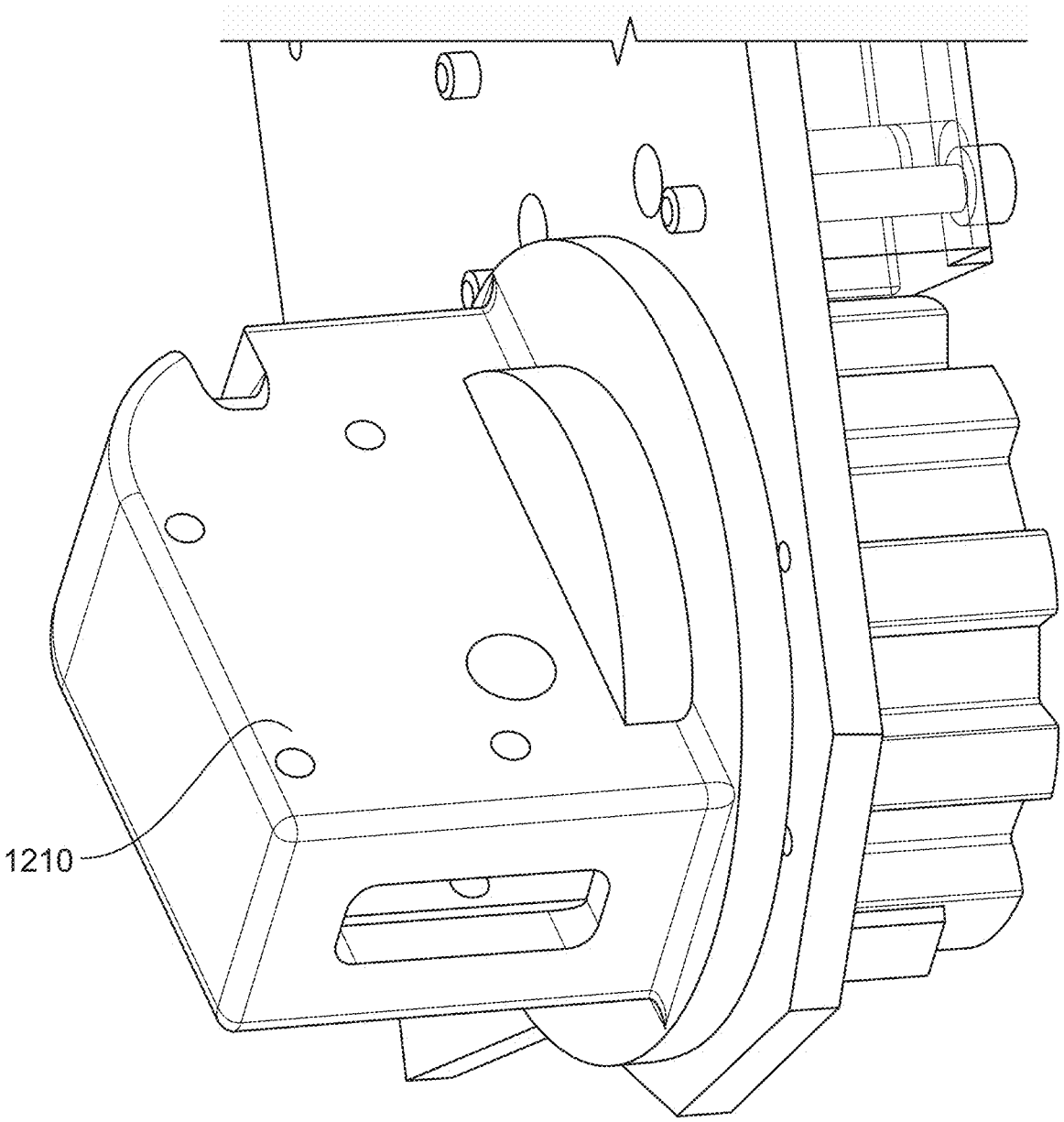
FIG. 12D illustrates a view of an arm shoulder component.
Figure 12E:
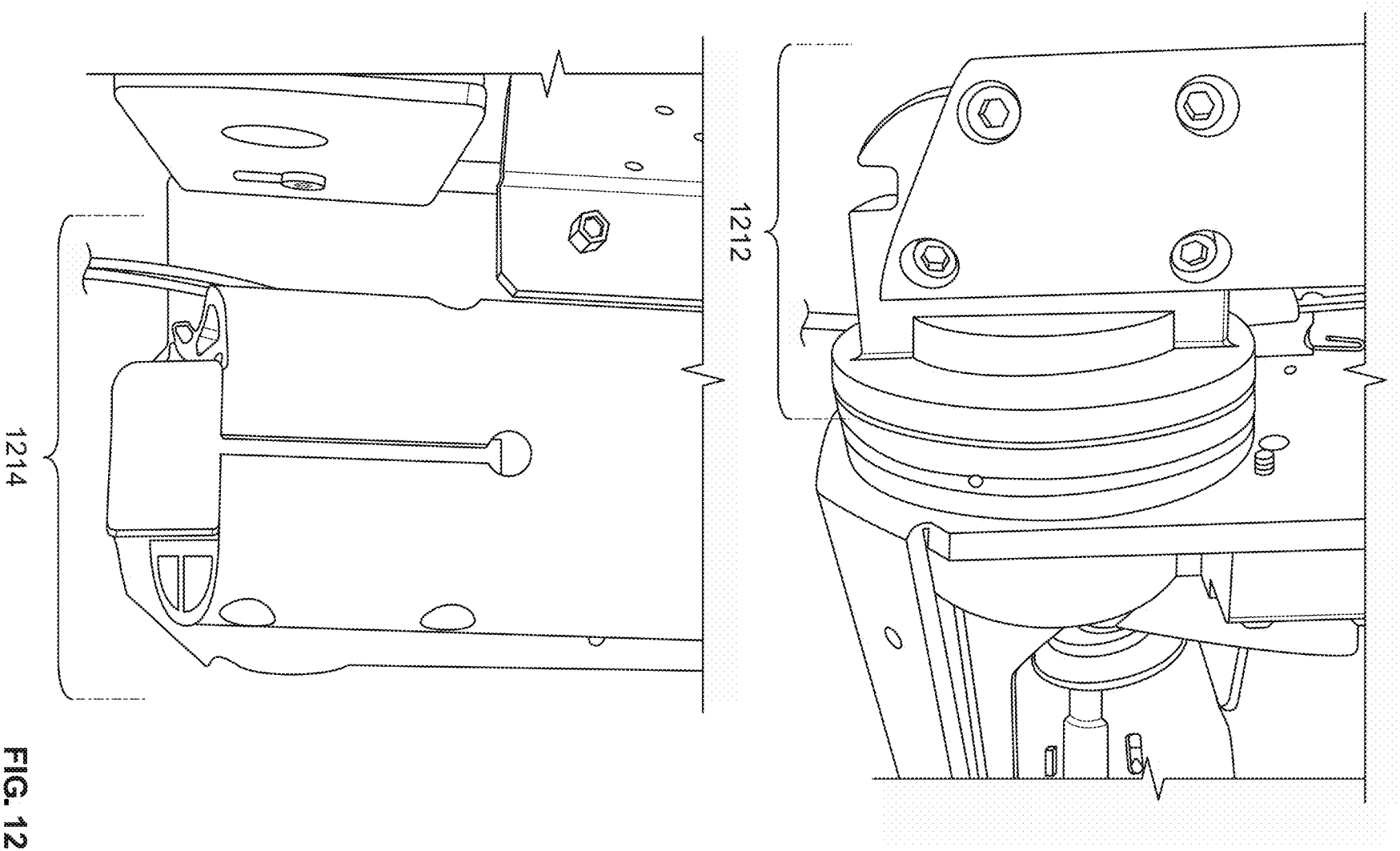
FIG. 12E illustrates an embodiment of an inner arm connected to a shoulder.

FIG. 12C illustrates an embodiment of a rotation lock mechanism. In this example, an alternative view of FIG. 12A is shown. In this example, part 1210 is external to the body of the trainer, and the inner arm of a telescoping arm bolts onto the portion 1210. FIG. 12D illustrates a view of an arm shoulder component (e.g., inside of shoulder 114 of FIG. 1A). The shoulder component 1210 of FIG. 12C is shown in this example. FIG. 12E illustrates an embodiment of an inner arm connected to a shoulder. Shown in the example of FIG. 12E are two views 1212 and 1214 of an inner arm bolted to the shoulder piece described above. A cover may then be placed over the shoulder with the inner arm bolted in (e.g., as shown at shoulder 114 of FIG. 1A).

In this example, when a user pushes the rotation control on the end of the arm, the mirror is exposed. The IR emitter-receiver pair detects the light reflected by the mirror, and then instructs a microprocessor to actuate the solenoid. The solenoid, when activated, pulls out the pin/key/dowel, which releases the ball bearing locks, and the key is pulled out of the keyway, thereby unlocking the rotation mechanism, and allowing the user to rotate the arm.

In this example, as long as the user holds the arm rotation control button down, they are able to rotate the arm. If the user lets go of the button, even if the pin is not lined up directly with a keyway, the next position for the arm rotation is found, due to the spring pushing the pin downward and the angling of the key and keyway facilitating placing of the key in the keyway. In some embodiments, detents are included for the arm position so that the user is able to feel the lockable rotation locations before they release the arm rotation control button. In some embodiments, the detent also assists in holding the arm up and preventing it from falling. Further details regarding the detent mechanism are described below.

Figure 13:
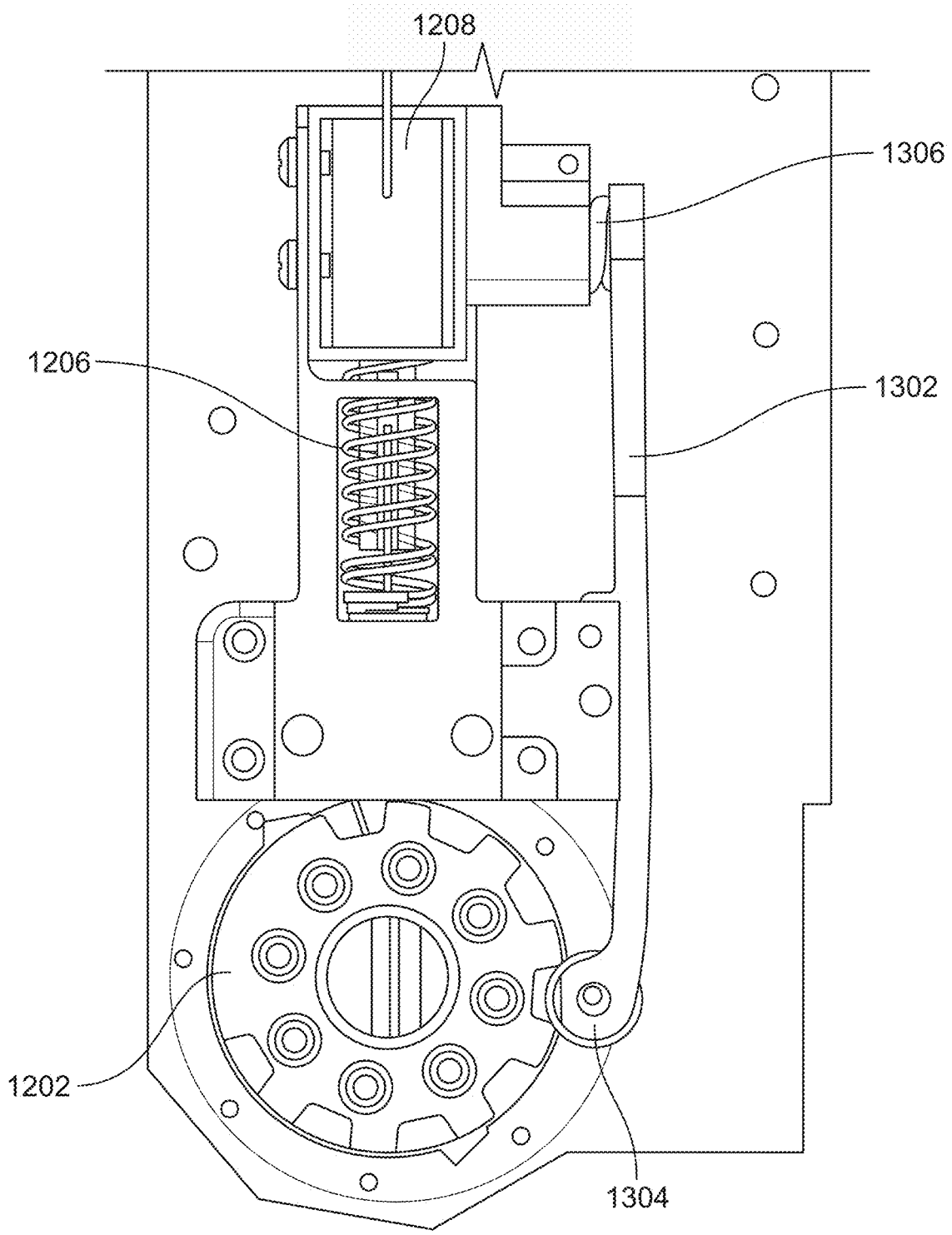
FIG. 13 illustrates an embodiment of an arm rotation detent mechanism.

FIG. 13 illustrates an embodiment of an arm rotation detent mechanism. In this example, the gear component with keyways 1202, spring 1206 for driving the pin/key into the gear 1202, and solenoid 1208 of FIGS. 12A-12C are shown. In this example, a lever 1302 is shown with a rolling wheel 1304. A portion of a spring attached to the lever on the end opposite to the wheel is also shown at 1306. Here, in this example, the rolling wheel detents onto the keyways of the gear/rotation indexing component (which determines the discrete angles at which the arm can be rotated).

Figure 14A:
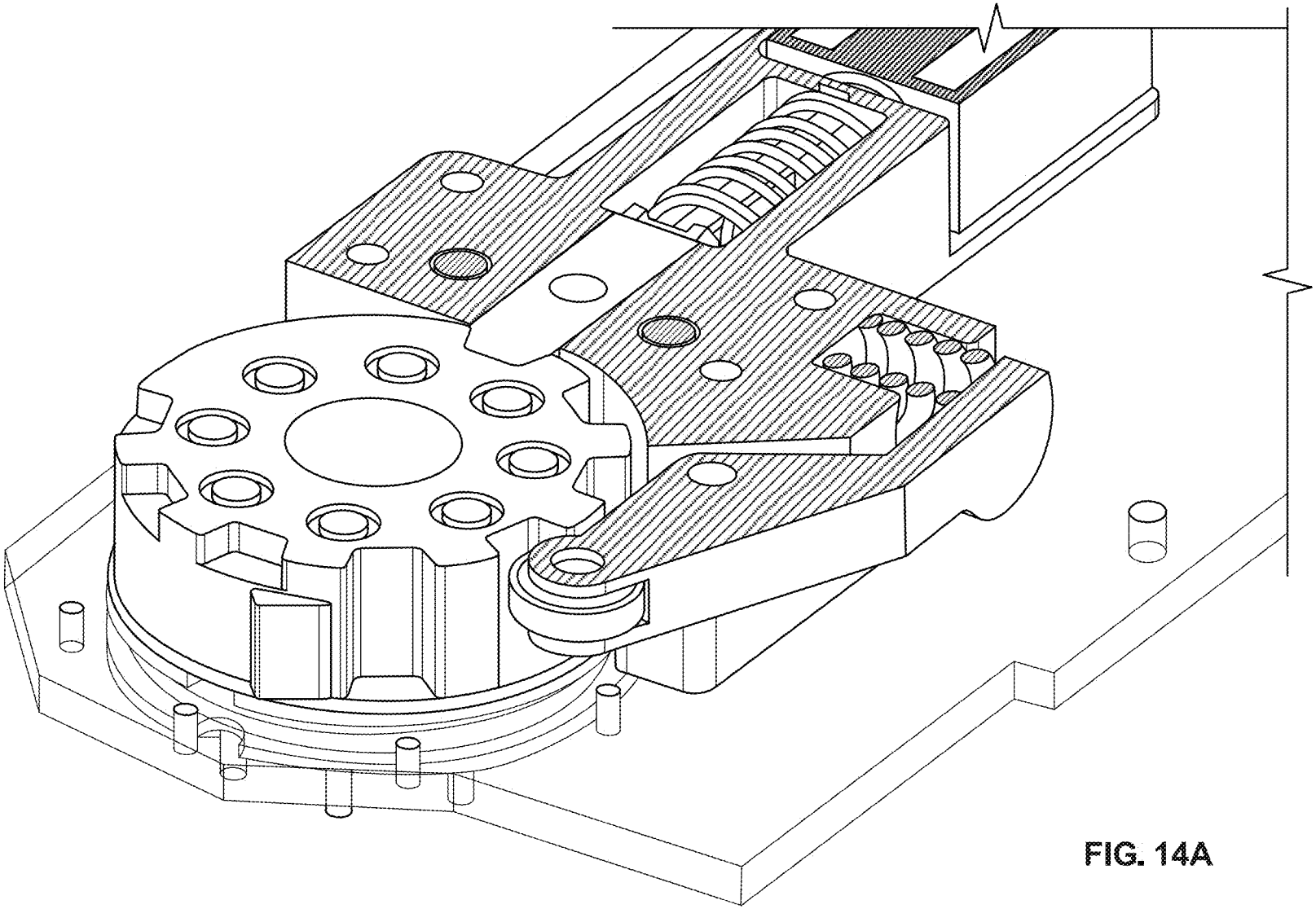
FIG. 14A illustrates an embodiment of an arm rotation detent mechanism.
Figure 14B:
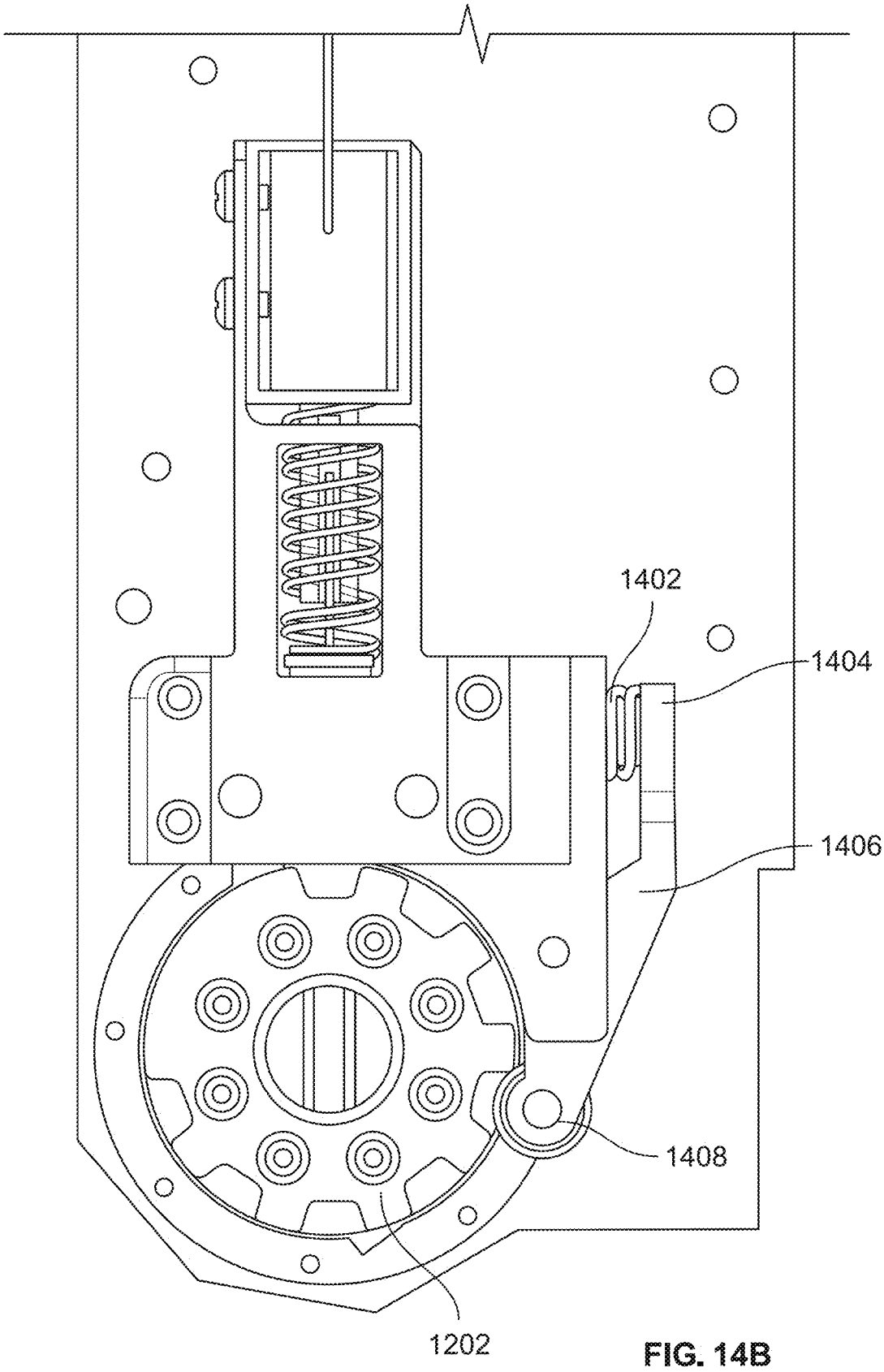
FIG. 14B illustrates an embodiment of an arm rotation detent mechanism.

FIG. 14A illustrates an embodiment of an arm rotation detent mechanism. The example of FIG. 14A is an alternative embodiment of the mechanism described in FIG. 13. FIG. 14B illustrates an embodiment of an arm rotation detent mechanism. In this example, an alternative view of the detent mechanism of FIG. 14A is shown. As shown in the example of FIG. 14B, spring 1402 pushes out the top part 1404 of the lever arm 1406, which causes the roller 1408 at the other end of the lever to be pushed into the keyways of the gear component (e.g., gear component 1202). In some embodiments, the strength of the spring is set such that it can cause the roller to be pushed into the keyway to hold the arm in place until the key drops into a keyway to lock the arm rotation position. The user feel of the detenting may be adjusted by adjusting the size of the roller, the size of the spring attached to the lever arm, etc.

The following are additional embodiments of arm rotation lock mechanisms.

Pin in Hole

Figure 15:
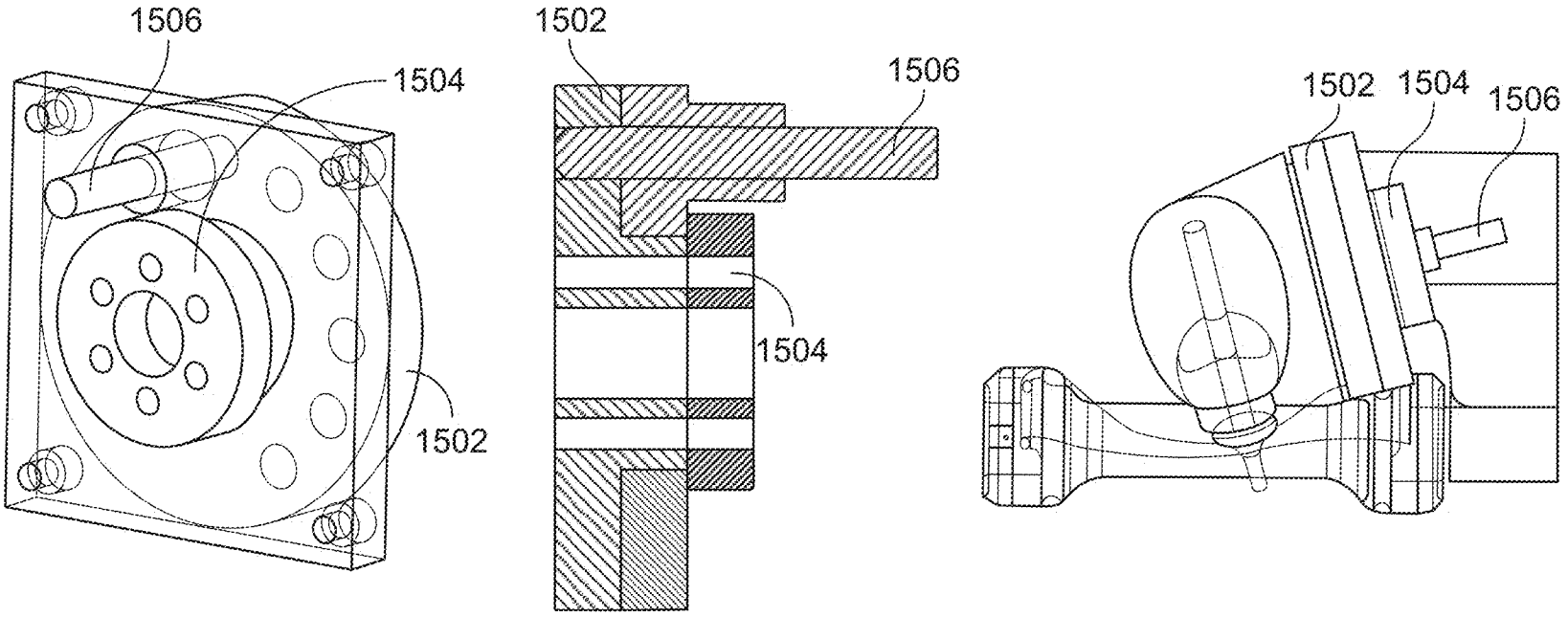
FIG. 15 illustrates an embodiment of an arm rotation lock mechanism.

FIG. 15 illustrates an embodiment of an arm rotation lock mechanism. In this example, a "pin in hole" rotation lock mechanism is shown. Three views of the "pin in hole" rotation lock mechanism are shown. In this example, component 1502 and component 1504 rotate with the arm, where the pin 1506 locks the component 1502 into different rotation positions. When the pin is retracted, the user can rotate the arm (which causes component 1502 to rotate). When the pin is placed back into the hole, the arm position (with respect to the rotation DOF) is locked in place.

Parking Pawl

Figure 16:
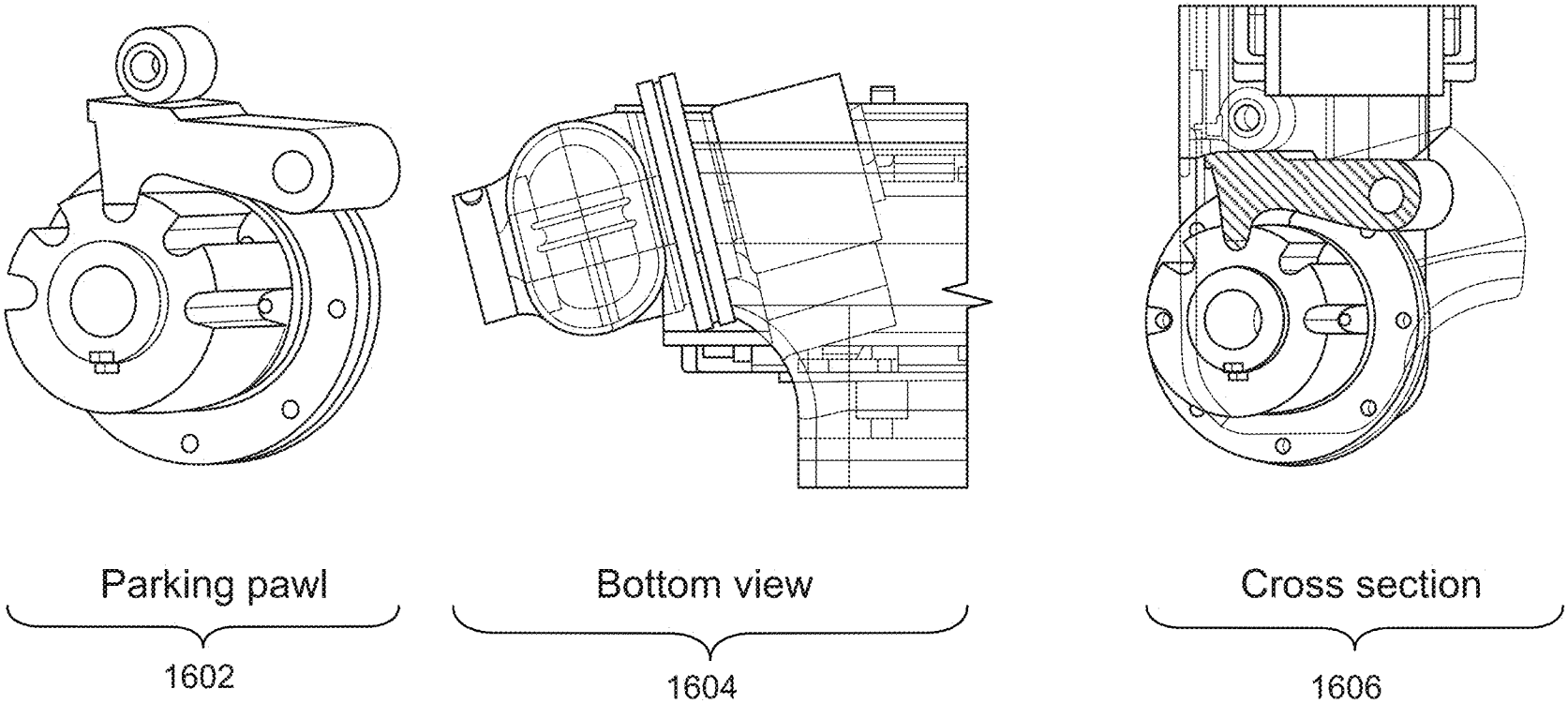
FIG. 16 illustrates an embodiment of an arm rotation lock mechanism.

FIG. 16 illustrates an embodiment of an arm rotation lock mechanism. In this example, a parking pawl type rotation lock mechanism is shown. Three views of the parking pawl type rotation lock mechanism are shown. In this example, a rotating lock is used instead of a linear lock. The parking pawl is shown at 1602. A bottom view of the parking pawl is shown at 1604. A cross-section view of the parking pawl is shown at 1606.

Slew Drive

Figure 17:
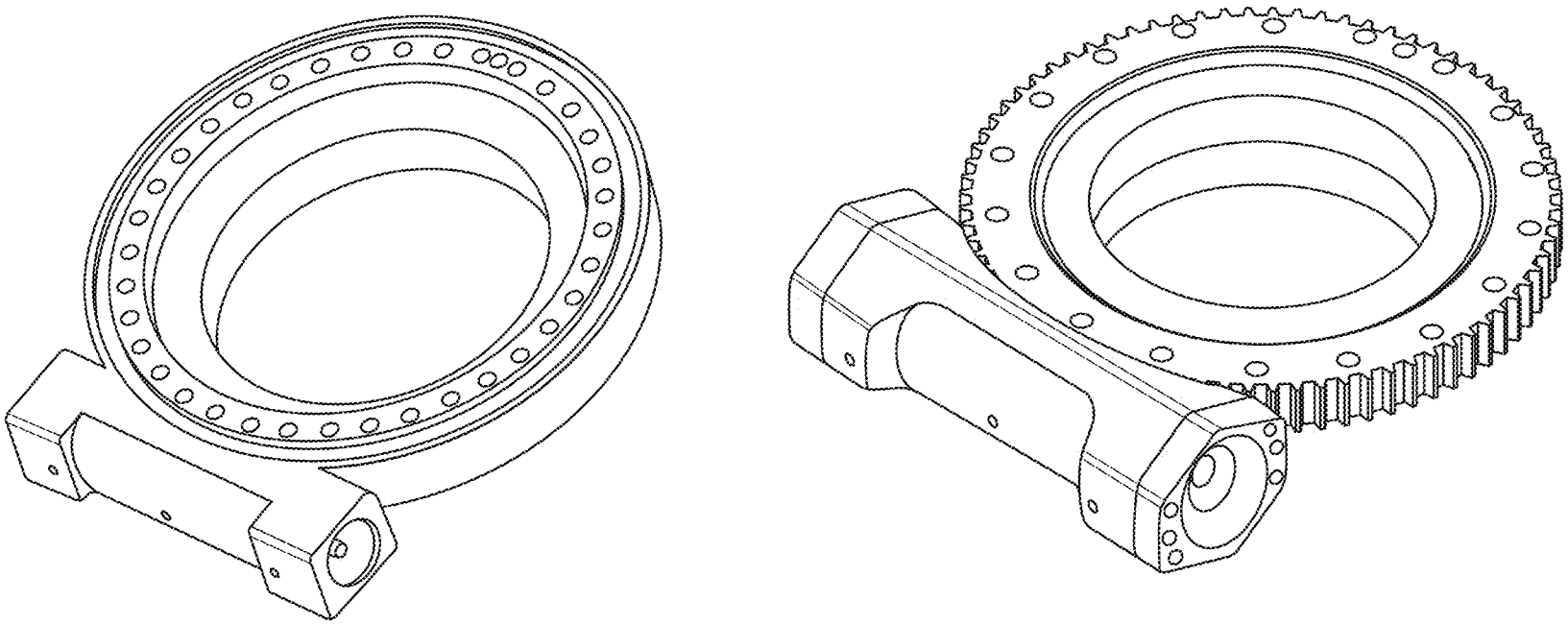
FIG. 17 illustrates an embodiment of an arm rotation lock mechanism.

FIG. 17 illustrates an embodiment of an arm rotation lock mechanism. In this example, a slew drive type rotation lock mechanism is shown. In this example, the slewing drive behaves similarly to a worm gear.

Spline into Hub

Figure 18A:
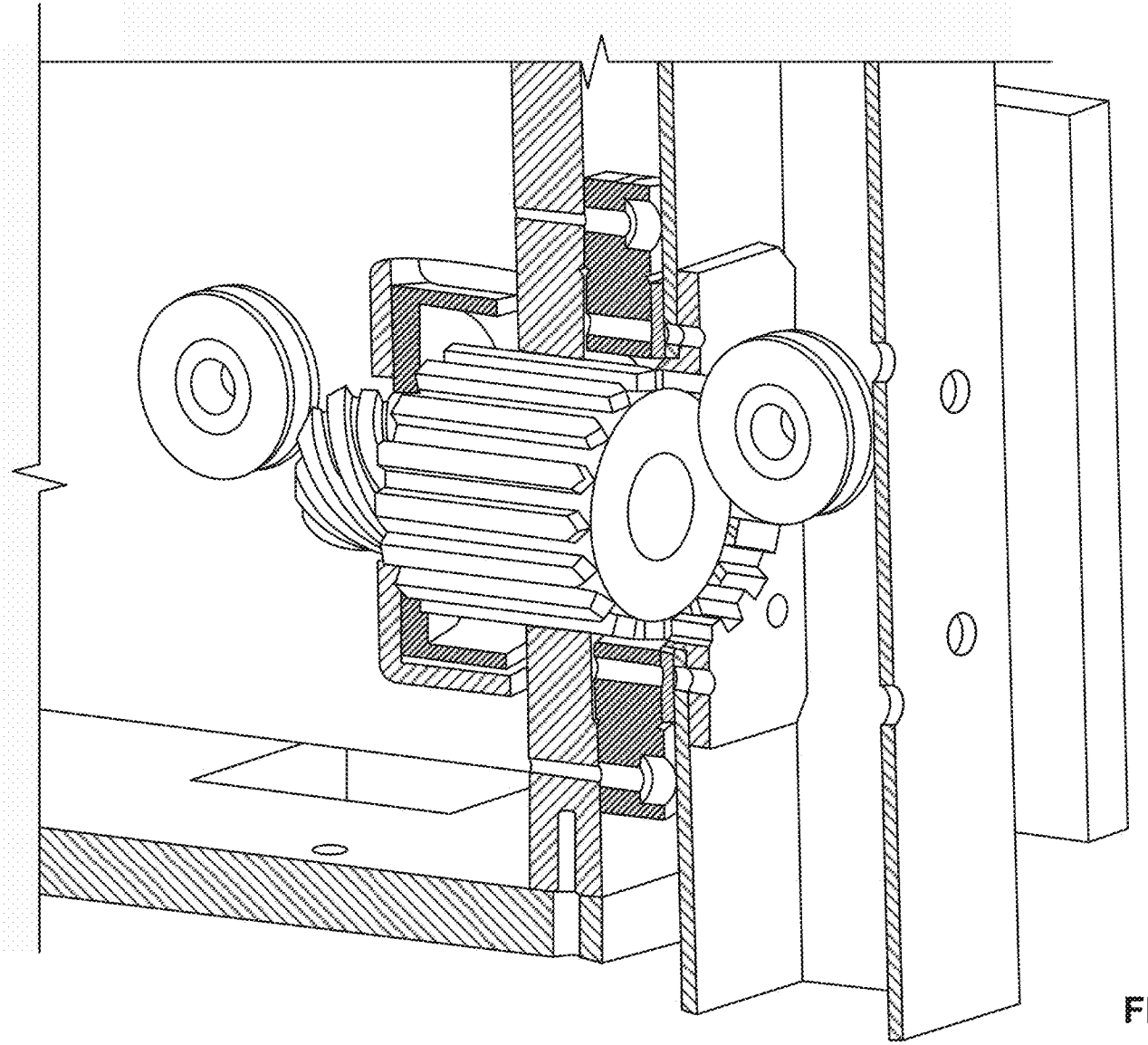
FIG. 18A illustrates an embodiment of an arm rotation lock mechanism.

FIG. 18A illustrates an embodiment of an arm rotation lock mechanism. In this example, a spline into hub type rotation lock mechanism is shown. In this example, a keyed rod enters into a keyed hole. The mechanism is then driven with a linear rotation.

Figure 18B:
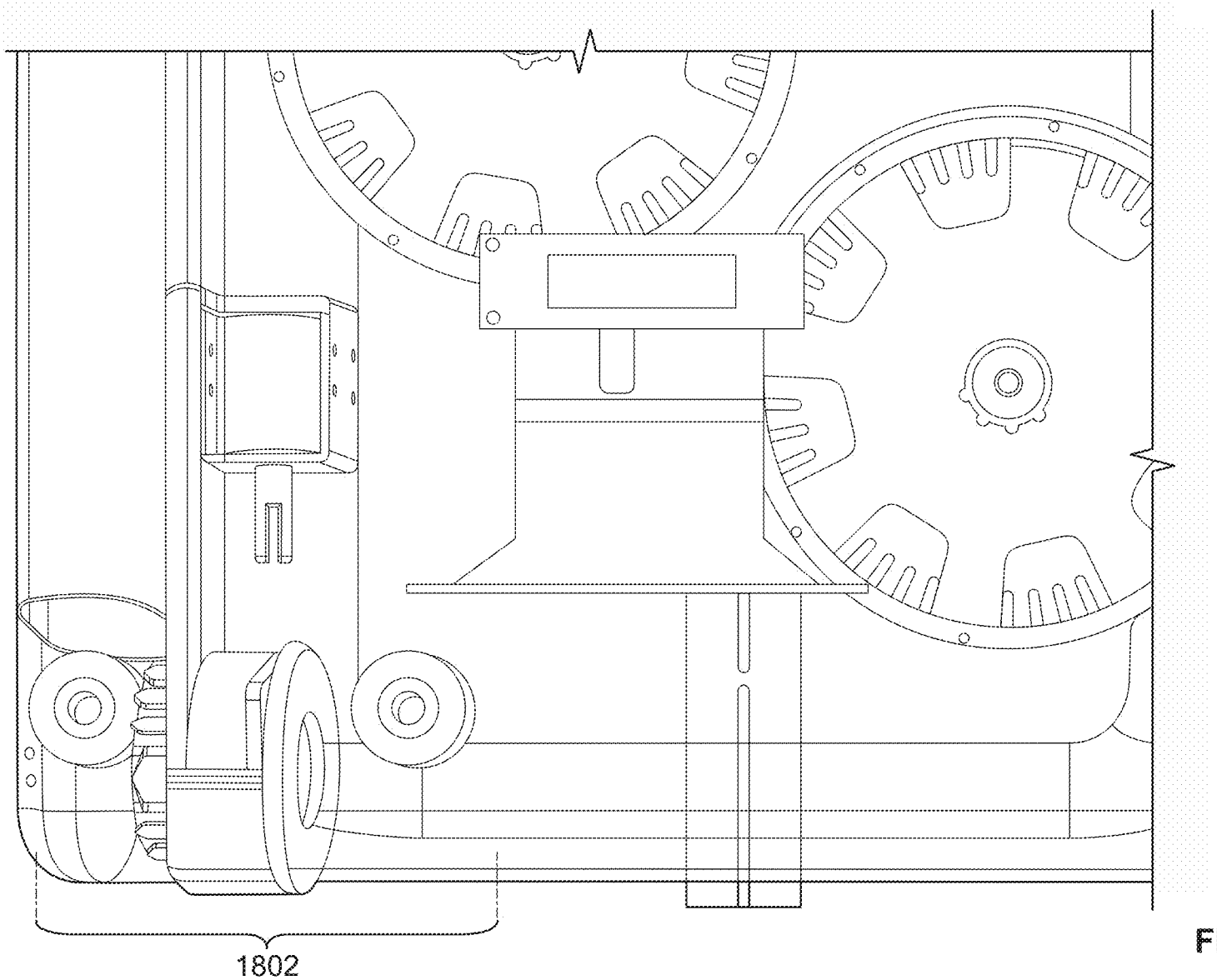
FIG. 18B illustrates a detail view of a spline rotation lock mechanism.

FIG. 18B illustrates a detail view of a spline rotation lock mechanism. In this example, a front view of a shoulder of the body of the trainer, including the spline of FIG. 18A, is shown at 1802.

Mechlok

Figure 19:
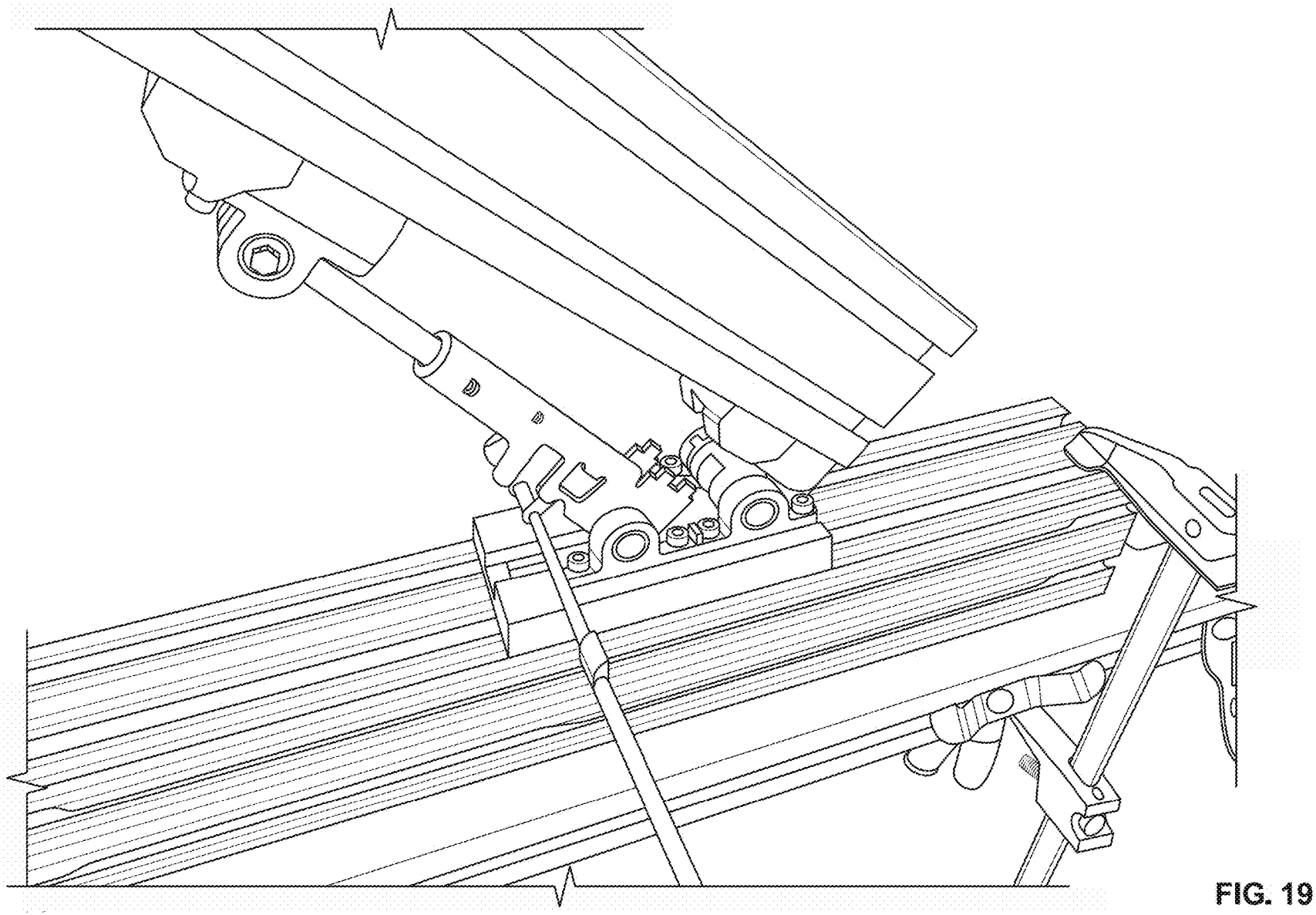
FIG. 19 illustrates an embodiment of an arm rotation lock mechanism.

FIG. 19 illustrates an embodiment of an arm rotation lock mechanism. In this example, a mechlok type rotation lock mechanism is shown. In this example, the arm lock mechanism includes a spring clutch. When a spring opens, a rod travels through, and the spring grabs the rod.

Spin Lock

Figure 20:
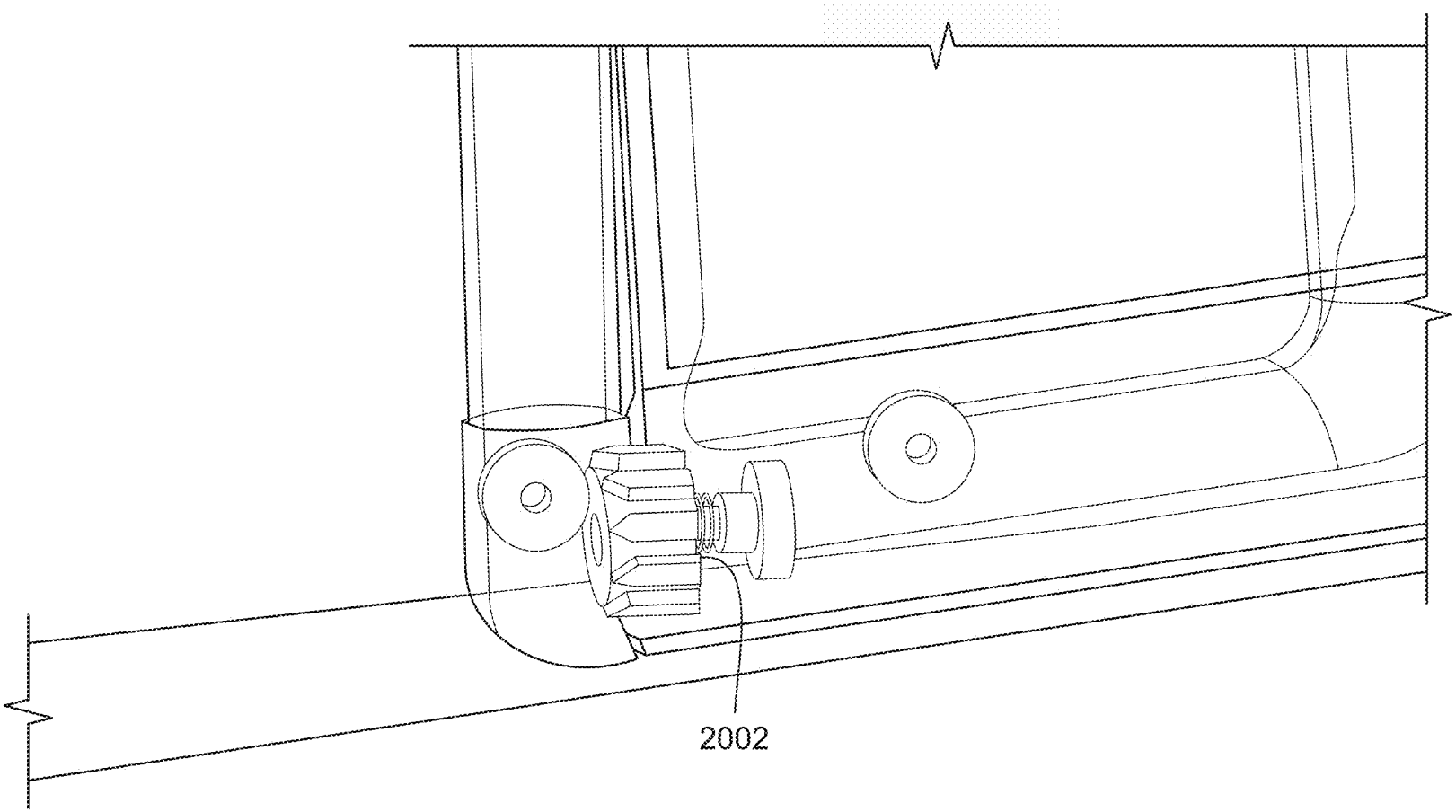
FIG. 20 illustrates an embodiment of an arm rotation lock mechanism.

FIG. 20 illustrates an embodiment of an arm rotation lock mechanism. In this example, a spin lock type rotation lock mechanism is shown at 2002.

Providing Counterforce

In some embodiments, components such as pneumatics (e.g., gas springs or dampers) are included in the telescoping to provide counterforce to improve the feel of the telescoping and/or the arm rotation. Another example of counterforce that can be included is friction. Other examples of counterforce include air springs, torsion springs, control of motor tension, etc.

As described above, in some embodiments of the trainer, the load element is one or more motors. In some embodiments, the motors are controlled in a manner that takes into account the telescoping and rotation of the arms and provide counterforces.

For example, the motors may continuously provide tension on the cable in order to prevent the cable from becoming slack. The motor applying tension to the cable may make it more difficult in some cases for the user to extend the arm. For example, when a user extends the arm, they are pulling against the motors and cable as well. Further, if the arms are pointed upwards, then a user is also fighting gravity when attempting to extend the arm. Thus, when the arms are pointed upwards and a user is trying to extend the arms, the user is acting against gravity, friction, as well as motor tensions. When the user is retracting the arm, the cable (which is being pulled by the motor) assists in the retraction. Further, if the arms are pointed down, then gravity can assist with retraction.

In some embodiments, the trainer is configured to use the motors to assist in telescoping. As one example, the trainer includes sensors for determining the rotation position of the arm (e.g., whether the arms are up or down). In some embodiments, if an arm is pointed downwards, and a user is attempting to retract the arm, then the motor controller increases torque provided by the motor to increase motor tension. This provides additional assistance when retracting the arms when they are pointed downwards (to help assist against gravity countering the user's efforts to retract the arm). If the trainer determines that the arms are pointed upwards and that the user is attempting to extend the arms, then the motor torque is lowered (e.g., to a minimum amount to prevent the cable from going completely slack in the system) so that the user is not fighting as much against the motor to raise the arm.

In some embodiments, with respect to rotation, counterforce is provided in order to counterbalance the arm when it is being rotated by the user. In some embodiments, the amount of counterbalancing to apply is dependent on both the rotation position and the telescoping position of the arm. As one example, suppose that there are five rotational arm positions and two telescoping positions. There are then ten positions for counterbalancing. For example, suppose that the arm is rotated to be horizontal to the ground and is fully retracted. In order to counterbalance the retracted arm, counter torque on the shoulder is applied. A greater counter torque would be needed to counter balance the arm if it were fully extended due to its greater moment arm.

In some embodiments, springs such as gas springs are used to offset the weight of the arm and provide counterbalancing. The force of the spring may be modulated to provide a nonlinear resistance. For example, a linear spring may be converted into a nonlinear resistance (e.g., by winding the spring a number of times so that only a short portion of the spring's overall movement is used).

In some embodiments, motors are attached to the shoulders of the trainer to provide the desired counter torque.

Additional Embodiments

In various embodiments, the telescoping of the arm (e.g., extraction/retraction) may be actuated in a fully automatic manner, a fully manual manner (e.g., by a user), or in a hybrid mode, with automatic assistance of manual arm telescoping.

As one example, a pneumatic extender or dampener may be used to facilitate automatic extension of the arm. With respect to retraction, in some embodiments, the arm is automatically retracted with the cable that is running through the arm (e.g., by the motor spooling/winding the cable back into the exercise machine, which can be used to cause the arm to retract).

In some embodiments, the user manually manipulates the arm, but the exercise machine provides assistance (e.g., semi-automated assistance) to help the user with telescoping of the arm (e.g., by using the motor to wind the cable to cause the arm to retract, or by using an automated mechanism such as a pneumatic extender to assist with arm extension, as described above).

In some embodiments, the exercise machine includes an interface or control to receive input usable to control the telescoping of the arms. As one example, the exercise machine includes a touch screen displaying a slider, where the user can manipulate the slider to cause the arms to move automatically to a desired position. As another example, a rocker-type switch (e.g., hydraulic, air, spring, etc.) may be used to cause extension of the arm.

In some embodiments, the arm includes a mechanism, such as a spring, configured to cause extension. In conjunction with an exercise machine that provides variable resistance via the use of a load element such as a motor, the cable may then be used to retract or extend the arm by varying the force generated by the motor. This type of control may be used to control the speed of extension/retraction, as well as the position to stop at.

In some embodiments, the arms may be automatically positioned based on a desired exercise to be performed.

In some embodiments, the rotation and/or telescoping of the arms is automated. In some embodiments, the automation occurs at a particular time. For example, the arms may come out and telescope in an automated manner, where upon completion of the positioning, the exercise machine goes into a user mode. This provides to the user an expectation of when extension occurs. After the exercise machine is in user mode, the telescoping is unlocked and the user may adjust the arm position manually if desired. In this way, the telescoping occurs in an automated manner as the user is getting the arms out (e.g., as part of an initialization in preparation of a user performing exercise, when the exercise machine first turns on, etc.). In some embodiments, the exercise machine locks the arms in certain positions to prevent adjustment.

In the example embodiments of a strength trainer described above, the arms have two degrees of freedom: first, the arm pivoting vertically (in the sagittal plane), and second, telescoping of the arm. In some embodiments, the exercise machine includes servo motors that are usable to move the arms through rotation (vertical pivot). The above automated mechanisms may be used to implement automated telescoping.

As described above, telescoping of the arms may be fully manual, fully automatic, or a hybrid of the two, where, for example, there is semi-automated assistance. There may be several steps that go from fully automatic to semi-automated assists. These include, for example, automating the lock/unlock of the telescoping, automating the retraction, automating the extension, and removal of cable tension load when unlocking. One example of semi-automated assistance is the following. A user pushes a button on the arm that unlocks the telescoping and simultaneously reduces the cable tension load. A spring (or other appropriate mechanism) is inside the arm that tends to push the arm to extension, where the cable tension load is set to be slightly stronger than the spring so that it would retract unless the user pulls on it, in which case it would be able to extend gently.

Example Sensors

In some embodiments, various sensors are used to facilitate implementation of telescoping arms on an exercise machine. As one example, the exercise machine has one or more position sensors to detect the position of each degree of freedom of the arm. For example, if the arm has two degrees of freedom, sagittal rotation (vertical pivoting) and telescoping, then one or more sensors are used to detect the rotation position of the arm, as well as the telescoped position of the arm.

In some embodiments, the exercise machine includes sensors for detecting locking/unlocking for each degree of freedom of the arms. In some embodiments, the exercise machine performs various actions based on the detected lock/unlock state of the arm/telescoping.

In some embodiments, when changing position of the arm, the zero point of the cable is reset. For example, changing the position of the arm (e.g., by telescoping the arm or changing its rotation) causes a certain amount of cable to be pulled out (or retracted/released in).

For example, suppose that the user is using the digital strength trainer, and the digital strength trainer is set to provide 100 pounds of resistive force (e.g., by producing a target torque of 100 pounds to draw the cable in, resisting a user's opposing pull on the cable). In some embodiments, if a user decides to unlock and adjust the position of the arm, the sensors detect the unlocking and/or adjustment of the arm position, and in response to such an event being detected, the torque generated by the motor is reduced (otherwise, the 100 pounds of force drawing in the cable, without the arm being locked and a person pulling on the arm, could cause the arm to slam back in). Thus, sensors used to detect locking/unlocking may be used by the exercise machine to determine whether to quickly drop weight before a user manipulates the arm.

In some embodiments, with respect to the zero-point, suppose that a user has locked the positon of the arm. That position is then designated as the new cable zero point. In this way, there is an adjustment point that changes the length of cable from the spool to the actuator. Suppose that the digital strength trainer is set to provide 100 pounds of force driving the cable to resist movement of the cable by the user. This 100 pounds of force will cause the cable to retract towards the end. In some embodiments, before the cable retracts to the end (e.g., at the last several inches), the exercise machine drops the weight. In some embodiments, the force/torque driving the cable is reduced as the zero-point is approached (e.g., within the last several inches, or at another point, as appropriate). In this way, the exercise machine system does not continue to pull at 100 pounds on the mechanical system of the trainer, generating heat and power. Further, the longevity of the rope and other components (e.g., a ball stop or other interface mechanism used to connect a handle to the cable, and also stop retracting of the cable) is improved. Further there is an improvement in safety to the user by avoiding pinching. Further, there is a tradeoff between the weight of an actuator/accessory connected to the cable (e.g., via a ball stop), and in some embodiments, the exercise machine determines how much to reduce the torque based on the weight of the actuator. For example, the exercise machine reduces the torque down to a point that matches the weight that is hanging off the end of the cable (e.g., weight of accessory) so that the accessory does not hang and drag the cable down (that is, the torque is not reduced completely to zero, but to a point that keeps the actuator in place and resists the actuator from falling due to gravity). In some embodiments, the accessories are smart accessories, where the exercise machine may determine what actuator is attached via a wired or wireless connection (e.g., Bluetooth), where the exercise machine may then know what actuator is attached and thereby determine the attached actuator's weight. In other embodiments, the exercise machine determines the weight of the accessory by measuring the weight of the accessory. The exercise machine may then use the determined weight of the accessory to determine how much to reduce the torque by. By resetting the cable zero point, the trainer is able to determine, as the zero point is approached, where to cut the weight/force applied by the motor.

Telescoping of the arms changes cable length. The pivot point may also cause a change in cable length.

In some embodiments, when the cable is at its zero position, the motor is driven with a certain amount of torque to prevent the cable or handle from sliding out. For example, the weight/force applied by the motor is selected to at least match the weight of an actuator or accessory hanging at the end of the cable (e.g., handle attached to end of cable). This secures accessories or actuators from hanging or falling out of the arm. In some embodiments, knowing which actuator is attached also facilitates intelligent setting of the torque applied by the motor. In some embodiments, the motor measures the weight of the accessory and applies an amount of torque that counters the weight of the accessory (or applies slightly more) so that the accessory does not fall and cause the cable to extend.

Thus, as described above, in some embodiments, in response to detecting unlocking of the arm (e.g., by a user in order to change its position), the exercise machine takes off all weight immediately so that the arm does not slam closed (as the force of the motor would pull the cable in, and potentially cause the arm to also pivot). In some embodiments, when it is detected by a sensor(s) that the arm is locked, the exercise machine determines the new zero point of the cable, and in some embodiments also provides a minimum weight, as described above, to secure any accessories.

In other embodiments, when the arm is unlocked and being adjusted/positioned, rather than taking off all weight, the weight is adjusted to at least partially support the weight of the arm. This provides assistance to the user, as it may make the arm feel less heavy (that is, the motor is driven with a torque that causes the cable to be pulled in with a force component that matches or opposes the force of gravity pulling the arm down).

As described above, in some embodiments, positioning of the arm may be performed automatically. In some embodiments, the exercise machine includes sensors to prevent the arms from striking objects (e.g., hitting a person or knocking down objects as the arm is moving).

In other embodiments, some or all of the sensors described above are not used. As one example, suppose that for telescoping of the arm, there is not a sensor to detect that the arm has been unlocked (which as described above, may be used to determine whether to turn the weight off before adjustment so that it does not shoot back due to motor pulling/retracting cable with maximum torque). In this case, the user may be instructed to turn off the weight before adjusting the arm (or the user otherwise knows to turn off the weight before unlocking/adjusting the arm). In some embodiments, as described above, a mechanism such as a damper is used to slow down the upswing of the arm when it is unlocked and the user is not countering the force applied to the cable by the motor. This provides a safety mechanism to control the motion of the arms.

In some embodiments, telescoping is permitted in only certain positions by the exercise machine. For example, sensors may be used to determine the position of the arm, and unlocking is only allowed by the exercise machine if the arm is in a permitted position. For example, the exercise machine only permits telescoping when the arm is in a high position (e.g., pointed upwards or in a stowed position).

In some embodiments, the exercise machine includes a sensor to detect that the arms are in a stowed position. Further details regarding stowing are described below. In some embodiments, in response to detecting that the arms are in a stowed position, the exercise machine automatically retracts the arms. In some embodiments, when the exercise machine is turned on, the exercise machine automatically extends the arms.

In some embodiments, rotation is not permitted unless the arms are fully extended.

Example Control of the Arm (Un)Locking/Position

Further details regarding locking and unlocking of the telescoping arms are described below. As described above, positioning of the arm may be: fully automated by the exercise machine, a fully manual process performed by the user, or a hybrid mode in which the user manually moves the arm, but is at least partially assisted in an automated manner by the exercise machine.

In one embodiment, if the arm movement is fully automatic, the exercise machine automatically, for example, performs a process of unlocking, extending/retracting of the arm, and locking of the telescoping. This is in contrast to a fully manual scenario, in which the user unlocks the arm, manually pushes in (retracts) or pulls out (extends) the arm, and then manually locks the arm.

In one example of a hybrid mode, the user performs an action to manually unlock the arm (e.g., by pressing a button, lever, or other actuator), and the exercise machine automatically extends (or retracts) the arm. The locking may then be performed manually by the user or automatically by the exercise machine.

Table 1 below illustrates example embodiments of manual and automatic telescoping movements.

TABLE 1

| Manual | Automatic* |
|---|---|
| Unstow | Unstow |
| Unlock | * |
| Extend | Spring Extend |
| Lock | * |
| Use | Use |
| Unlock | * |
| Retract | Cable Retract |
| Lock | * |
| Stow | Stow |

Different sensors may be used to accommodate the different types of automated/manual/hybrid telescoping mechanisms described above.

Example Stowing of the Telescoping Arms

The following are embodiments regarding stowing of telescoping arms. For example, consider the example exercise machine of FIGS. 1A-1F. In this example, the pivot for the arms (to pivot vertically) is at the base of the machine (e.g., at the shoulders), and in one embodiment, the arms are stowed by placing them in an upward configuration, as shown in the example of FIG. 1A. In some embodiments, the exercise machine includes mechanisms for preventing the arms from falling down from their upward configuration (e.g., to prevent the arms from falling due to gravity when unlatched).

In some embodiments, dampening is performed on the arm to slow the arm if it is falling. For example, without dampening, once unlocked and pulled down on, the arm will come down quickly due to gravity. Dampening may be used to slow the falling motion of the arm. A spring may also be used to slow the coming down of the arm. A laptop-type hinge with built-in resistance is an example of a counter-force mechanism that may be used.

In some embodiments, when stowing the arms, the arms are pointed vertically upward, and parallel with the body/frame of the machine. In some embodiments, the exercise machine includes a stowing mechanism (which may be separate from the bottom hinge/pivot point) that controls the position of the arm in its upward position. For example, in some embodiments, the exercise machine includes a home for the arm to snap into, such as a mechanical or magnetic attachment or detent that allows the arms to be stowed pointing upwards in a manner that is parallel with the machine, and that prevents motion until released.

In some embodiments, the exercise machine automatically extends/retracts the arm when the arm is stowed. In this example case, when the user turns on the machine, the arms extend automatically. The user then pivots the arms down. When the user is done and stows the arm, the arm is automatically retracted.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. A weight training machine, comprising:

a central console including a motor;

an arm having a length attached on either side of the central console by a joint that allows rotation of the arm in a substantially vertical plane; and a cable routed from the motor through the arm to a distal end of the arm wherein the cable terminates at an attachment point;

wherein the arm comprises an outer section and an inner section arranged to telescope in a manner that changes the length of the arm; and wherein the arm includes a control for unlocking telescoping, wherein telescoping of the arm is locked when a component coupled to the control is in a hole in the inner section, wherein in response to activation of the control by a user, the component is lifted from the hole in the inner section, unlocking the outer section from the inner section, wherein the component comprises a wheel, and wherein the wheel rolls along a track of the inner section when telescoping the arm.

2. The weight training machine of claim 1, wherein the outer section and the inner section are arranged such that the outer section moves relative to the inner section.

3. The weight training machine of claim 1, wherein the control for unlocking telescoping of the arm is located on the outer section.

4. The weight training machine of claim 1, wherein the control is coupled to a linkage that prevents the component from being lifted from the hole when the control is not being activated.

5. The weight training machine of claim 1, wherein the inner section includes a plurality of holes, and wherein each hole corresponds to a position at which telescoping of the arm is lockable.

6. The weight training machine of claim 1, wherein the weight training machine includes a control for adjusting the rotation of the arm in the substantially vertical plane.

7. The weight training machine of claim 6, wherein the control for adjusting the rotation of the arm in the substantially vertical plane is located on the outer section of the arm.

8. The weight training machine of claim 1, wherein the weight training machine comprises two arms.

9. A weight training machine comprising:

a central console including a motor;

an arm having a length attached on either side of the central console by a joint that allows rotation of the arm in a substantially vertical plane; and a cable routed from the motor through the arm to a distal end of the arm wherein the cable terminates at an attachment point;

wherein the arm comprises an outer section and an inner section arranged to telescope in a manner that changes the length of the arm; and wherein the weight training machine includes a control for adjusting the rotation of the arm in the substantially vertical plane, and wherein in response to user activation of the control, a reflective surface is exposed.

10. The weight training machine of claim 9, wherein the rotation of the arm in the substantially vertical plane is unlocked in response to detection of light reflected by the exposed reflective surface.

11. A weight training machine comprising:

a central console including a motor;

an arm having a length attached on either side of the central console by a joint that allows rotation of the arm in a substantially vertical plane; and a cable routed from the motor through the arm to a distal end of the arm wherein the cable terminates at an attachment point;

wherein the arm comprises an outer section and an inner section arranged to telescope in a manner that changes the length of the arm; and wherein the weight training machine includes a control for adjusting the rotation of the arm in the substantially vertical plane, and wherein the weight training machine comprises an IR emitter-receiver pair.

12. A weight training machine comprising:

a central console including a motor;

an arm having a length attached on either side of the central console by a joint that allows rotation of the arm in a substantially vertical plane; and a cable routed from the motor through the arm to a distal end of the arm wherein the cable terminates at an attachment point;

wherein the arm comprises an outer section and an inner section arranged to telescope in a manner that changes the length of the arm; and wherein the weight training machine includes a control for adjusting the rotation of the arm in the substantially vertical plane, and wherein in response to user activation of the control, a wireless signal is transmitted.

13. The weight training machine of claim 12, wherein in response to detection of the wireless signal, the rotation of the arm in the substantially vertical plane is unlocked.

14. The weight training machine of claim 12, wherein a solenoid is activated in response to detection of the wireless signal, and wherein the solenoid is used to unlock the rotation of the arm in the substantially vertical plane.

* * * * *